US006566043B2

(12) United States Patent
Kataoka et al.

(10) Patent No.: US 6,566,043 B2
(45) Date of Patent: May 20, 2003

(54) SILVER HALIDE PHOTOGRAPHIC LIGHT-SENSITIVE MATERIAL

(75) Inventors: Emiko Kataoka, Hino (JP); Nobuaki Kagawa, Hino (JP); Tatsuo Tanaka, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/942,402

(22) Filed: Aug. 30, 2001

(65) Prior Publication Data

US 2002/0081543 A1 Jun. 27, 2002

(30) Foreign Application Priority Data

Sep. 4, 2000 (JP) ..... 2000-266877
Nov. 16, 2000 (JP) ..... 2000-349538

(51) Int. Cl.[7] ..... G03C 7/305; G03C 7/392; G03C 1/34

(52) U.S. Cl. ..... 430/544; 430/551; 430/611; 430/613; 430/614

(58) Field of Search ..... 430/611, 551, 430/613, 614, 544

(56) References Cited

U.S. PATENT DOCUMENTS 4,203,766 A * 5/1980 Bourgeois et al. ..... 430/218
5,656,419 A * 8/1997 Toya et al. ..... 430/611
5,807,662 A 9/1998 Takahashi ..... 430/611
5,851,753 A * 12/1998 Yamada et al. ..... 430/611
6,127,109 A * 10/2000 Goan ..... 430/611

FOREIGN PATENT DOCUMENTS

EP 0809136 11/1997
JP 63294554 1/1988
JP 63106652 5/1988
JP 9230530 5/1997
JP 11174617 2/1999

OTHER PUBLICATIONS

European Search Report EP 01 12 1093 *1 page each of English Abstracts only.

* cited by examiner

*Primary Examiner*—Richard L. Schilling
(74) *Attorney, Agent, or Firm*—Muserlian, Lucas and Mercanti, LLP

(57) ABSTRACT

The present invention is to provide a silver halide photographic light-sensitive material comprising a support having thereon a light-sensitive silver halide emulsion layer comprising a compound represented by Formula, Formula 1

Z—S—X wherein Z represents a group represented by Formula 1–2; X represents a hydrogen atom or Z—S—, Formula 1-2 wherein $A_1$, $A_2$, $A_3$, $A_4$, and $A_5$ each represent =N—, =N(→O)—, or =$CR_{91}$—, in which $R_{91}$ represents a substituent, and at least two of $A_1$, $A_2$, $A_3$, $A_4$, and $A_5$ are respectively =N(→O)— and =$CR_{91}$—.

12 Claims, No Drawings

SILVER HALIDE PHOTOGRAPHIC LIGHT-SENSITIVE MATERIAL

FIELD OF THE INVENTION

The present invention relates to a silver halide photographic light-sensitive material (hereinafter simply referred to as a light-sensitive material or a photographic meterial), a mercapto compound, and a disulfide compound, and in more detail to a silver halide light-sensitive material, comprising said compound, which exhibits minimized fogging, and excellent pressure resistance, as well as excellent sensitivity.

BACKGROUND OF THE INVENTION

Generally, various pressures are applied onto light-sensitive materials coated with silver halide emulsions. For example, sheet films such as graphic arts light-sensitive materials, and medical direct radiographic materials are manually handled which frequently results in being folded and curled. As noted above, when various pressures are applied onto photographic light-sensitive materials, silver halide grains are subjected to application of pressure through media such as gelatin as the binder of silver halide grains, and a plastic film as the support. When silver halide grains are subjected to application of pressure, variation of photographic performance results. Details are reported, for example, by K. B. Mather, J. Opt. Soc. Am., 38, 1054 (1948), P. Faelens and P. deSmet, Sci. et Ind. Phot., 24, No. 5, 178 (1954), P. Faelens, J. Phot. Sci., 2, 105 (1954), and others.

In addition, sought is further improvement of retaining performance of light-sensitive materials, particularly retardation of an increase in fogging during storage.

Camera light-sensitive materials are developed varying period of time from immediate to several months or one year after exposure. It is preferable that during such an elapse of time, fogging performance be maintained.

SUMMARY OF THE INVENTION

An objective of the present invention is to provide a silver halide photographic light-sensitive material, comprising mercapto compounds and disulfide compounds, which exhibits low fogging, excellent pressure resistance, and excellent sensitivity, and is to provide mercapto compounds as well as disulfide compounds.

The objective of the present invention has been achieved employing the embodiments below.

1. A silver halide photographic light-sensitive material comprising a support having thereon a light-sensitive silver halide emulsion layer comprising a compound represented by Formula, Formula 1

Z—S—X wherein Z represents a group represented by Formula 1–2; X represents a hydrogen atom or Z—S—, Formula 1-2

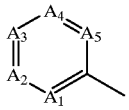

wherein $A_1$, $A_2$, $A_3$, $A_4$, and $A_5$ each represent =N—, =N(→O)—, or =$CR_{91}$—, in which $R_{91}$ represents a substituent, and at least two of $A_1$, $A_2$, $A_3$, $A_4$, and $A_5$ are respectively =N(→O)—and =$CR_{91}$—.

2. The photographic material of item 1, wherein the compound represented by Formula 1 is selected from the group of compounds represented by Formula 6 to Formula 14, Formula 6

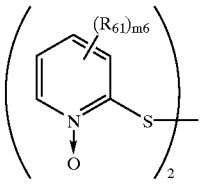

Formula 7

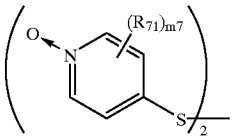

Formula 8

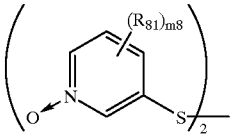

Formula 9

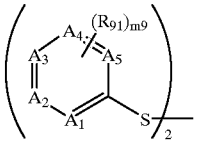

Formula 10

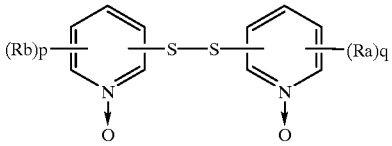

Formula 11

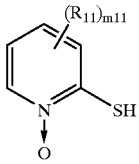

Formula 12

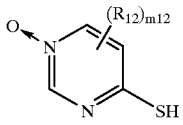

-continued

Formula 13

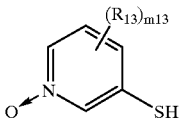

Formula 14

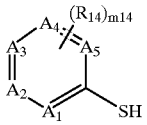

wherein $R_{61}$, $R_{71}$, $R_{81}$, and $R_{91}$ each represent a substituent; $m_6$ represents 1 to 4; $m_7$ and $m_8$ represent an integer of 0 to 4; $m_9$ represents an integer of 0 to 3; when $m_6$, $m_7$, $m_8$ and $m_9$ are 2 or more, $R_{61}$, $R_{71}$, $R_{81}$, and $R_{91}$ may be a different substituent and may bond to each other to form a condensation ring; $A_1$, $A_2$, $A_3$, $A_4$, and $A_5$ each represent =N—, —$CR_{92}$, or =N(→O)—, and at least two of $A_1$, $A_2$, $A_3$, $A_4$, and $A_5$ represent =N— or =N(→O)—, and at least one represents =N(→O)—; and $R_{92}$ represents a substituent; Ra and Rb each represent an electron attractive group and may be the same or different, and p and q each represent integer of 1 to 4; $R_{11}$, $R_{12}$, $R_{13}$, an $R_{14}$ each represent a substituent; $m_{11}$ represents an integer of 1 to 4; $m_{12}$ and $m_{13}$ each represent an integer of 0 to 4; $m_{14}$ represents an integer of 0 to 3; $A_1$, $A_2$, $A_3$, $A_4$, and $A_5$ each are the same as each of Formula 9.

3. The photographic material of item 2, wherein the compound represented by Formula 1 is selected from the group of compounds represented by Formula 6 to Formula 10, Formula 6

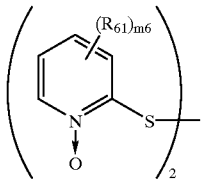

Formula 7

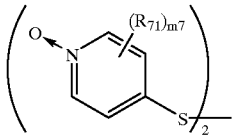

Formula 8

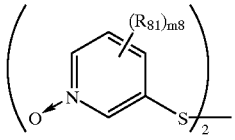

Formula 9

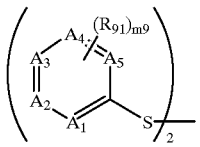

-continued

Formula 10

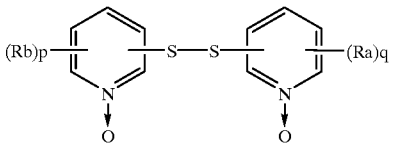

wherein $R_{61}$, $R_{71}$, $R_{81}$, and $R_{91}$ each represent a substituent; $m_6$ represents an integer of 1 to 4; $m_7$ and $m_8$ represent 0 to 4; $m_9$ represents an integer of 0 to 3; when $m_6$, $m_7$, $m_8$ and $m_9$ are 2 or more, $R_{61}$, $R_{71}$, $R_{81}$, and $R_{91}$ may be a different substituent and may bond to each other to form a condensation ring; $A_1$, $A_2$, $A_3$, $A_4$, and $A_5$ each represent =N—, =CR—, or =N(→O)—, and at least two of $A_1$, $A_2$, $A_3$, $A_4$, and $A_5$ represent =N— or =N(→O)—, and at least one represents =N(→O)—; and $R_{92}$ represents a substituent;

wherein Ra and Rb each represent an electron attractive group and may be the same or different, and p and q each represent an integer of 1 to 4.

4. The photographic material of item 2, wherein the compound represented by Formula 1 is selected from the group of compounds represented by Formula 11 to Formula 14.

Formula 11

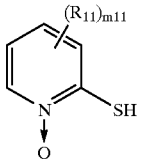

Formula 12

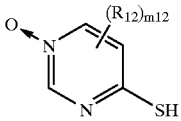

Formula 13

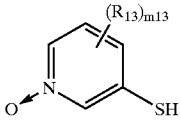

Formula 14

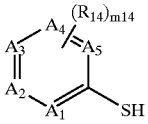

wherein $R_{11}$, $R_{12}$, $R_{13}$, and $R_{14}$ each represent a substituent; $m_{11}$ represents an integer of 1 to 4; $m_{12}$ and $m_{13}$ each represent an integer of 0 to 4; $m_{14}$ represents an integer of 0 to 3; and $A_1$, $A_2$, $A_3$, $A_4$, and $A_5$ each are the same as each of Formula 9.

5. The photographic material of item 3, wherein each $R_{61}$, $R_{71}$, $R_{81}$, and $R_{91}$ in Formula 6 to Formula 9 represents a group which promotes adsorption onto silver halide grains.

6. The silver halide light-sensitive material of item 1, wherein the compound is contained in an amount of $1\times10^{-7}$ to $1\times10^{-1}$ mole per mole of Ag.

7. The silver halide light-sensitive material of item 3, wherein the compound is represented by Formula 10, Formula 10

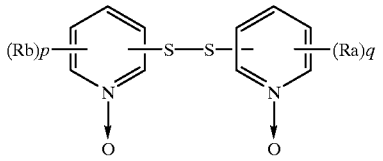

wherein Ra and Rb each represent an electron attractive group and may be the same or different, and p and q each represent an integer of 1 to 4.

8. The photographic material of item 3, wherein the compound is represented by Formula 6, Formula 6

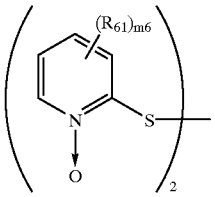

wherein $R_{61}$ represent a substituent and $m_6$ represents an integer of 1 to 4, when $m_6$ is 2 or more, $R_{61}$ may be a different substituent and may bond to each other to form a condensation ring.

9. The photographic material of item 3, wherein the compound is represented by Formula 7, Formula 7

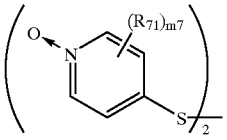

wherein $R_{71}$ represent a substituent and $m_7$ represents an integer of 0 to 4, when $m_7$ is 2 or more, $R_{71}$ may be a different substituent and may bond to each other to form a condensation ring.

10. The silver halide light-sensitive material of item 3, wherein the compound is represented by Formula 8, Formula 8

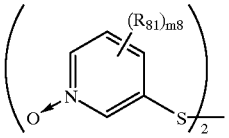

wherein $R_{81}$ represent a substituent and $m_8$ represents an integer of 0 to 4, when $m_8$ is 2 or more, $R_{81}$ may be a different substituent and may bond to each other to form a condensation ring.

11. The photographic material of item 3, wherein the compound is represented by Formula 9, Formula 9

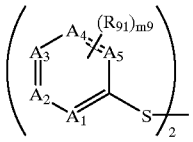

wherein $A_1$, $A_2$, $A_3$, $A_4$, and $A_5$ each represent =N—, =CR—, or =N(→O)—, and at least two of $A_1$, $A_2$, $A_3$, $A_4$, and $A_5$ represent =N— or =N(→O)—, and at least one represents =N(→O)—; and $R_{92}$ represents a substituent;

12. The photographic material of item 1, wherein the emulsion is subjected to reduction sensitization.

13. The photographic material of item 3, wherein the emulsion contains a tabular silver halide grain.

14. A photographic material comprising a compound represented by Formulas 2 to 5, 6-2, and 7-2.

Formula 2

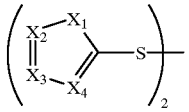

Formula 3

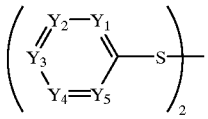

Formula 4

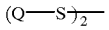

Formula 5

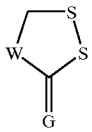

Formula 6-2

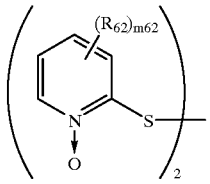

Formula 7-2

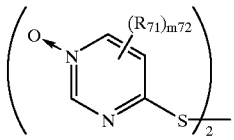

wherein $X_1$ represents —$NR_{21}$— or —O—; $X_2$, $X_3$, and $X_4$ each represents =$CR_{22}$— or =N—; both $R_{21}$ and $R_{22}$ represent a hydrogen atom or a substituent; $X_1$, $X_2$, $X_3$, and $X_4$ may form a condensation ring with each other, however, all of $X_1$, $X_2$, $X_3$, and $X_4$ are not a nitrogen atom; $Y_1$, $Y_2$, $Y_3$, $Y_4$, and $Y_5$ each represent =N— or =$CR_{31}$—, however, any one of $Y_1$, $Y_3$ and $Y_5$ is not =N—; Q represents a group of atoms necessary for forming a 5-membered or 6-membered heterocyclic ring comprising at least one of —O—, —S—, —N<, —$SO_2$—, —CO—, or $NR_{31}CO$—, wherein $R_{31}$ represents a hydrogen atom or a substituent; G represents an oxygen atom and a sulfur atom; W represents —S—S—C(=G)— as well as a group of atoms necessary to form a 5-membered or 6-membered ring, and may have a substituent which may form a ring along with W; $R_{62}$ represents an alkyl group having at least 2 carbon atoms, an aryl group, a cycloalkyl group, a hydroxy group, a carboxy group, a nitro group, a trifluoromethyl group, an amido group, a carbamoyl group, an alkyloxycarbonyl group, an aryloxycarbonyl group, a carbonyloxy group, a cyano group, a bromine atom, an iodine atom, a fluorine atom, an alkoxy group, an aryloxy group, a sulfonyl group, a sulfonamido group, a sulfamoyl group, an amino group, an alkylamino group, or a hydroxyamino group, $m_{62}$ represents an integer of 1 to 4, and when $m_{62}$ is at least 2, $R_{62}$ may be a different group and may bond to each other to form a condensation ring; $R_{72}$ represents a substituent, and $m_{72}$ represents an integer of 1 to 4; $R_{81}$ represents a substituent and $m_8$ represents an integer of 0 to 4; $A_1$, $A_2$, $A_3$, $A_4$, and $A_5$ each represent =N—, $=CR_{92}$— or =N(→O)—, at least two of $A_1$, $A_2$, $A_3$, $A_4$, and $A_5$ represent =N— or =N(→O)—, and at least one represents =N(→O)—; and $R_{91}$ and $R_{92}$ each represent a substituent, and $m_9$ represents an integer of 0 to 3.

DETAILED DESCRIPTION OF THE INVENTION

The present invention will now be detailed.

In Formula 1, Z represents a group represented by Formula 1–2; X represents a hydrogen atom or Z—S—; $A_1$, $A_2$, $A_3$, $A_4$, and $A_5$ in Formula 1–2 each represent =N—, =N(→O)—, or $=CR_{91}$—, in which $R_{91}$ represents a substituent, and at least two of $A_1$, $A_2$, $A_3$, $A_4$, and $A_5$ are respectively =N(→O)—, and $=CR_{91}$—, that means at least one of $A_1$, $A_2$, $A_3$, $A_4$, and $A_5$ represents =N(→O)—, and at the same time at least one of the rest represents $=CR_{91}$—. Substituents represented by $R_{91}$ include an alkyl group (for example, a methyl group, an ethyl group, an isopropyl group, a hydroxyethyl group, a stearyl group, a dodecyl group, an eicocyl group, a dococyl group, and an oleyl group); a cycloalkyl group (for example, a cyclopropyl group and a cyclohexyl group); an aryl group (for example, a phenyl group, a p-tetradecanyloxyphenyl group, an o-octadecanylaminophenyl group, a naphthyl group, and a hydroxyphenyl group); a hydroxy group; a carboxy group; a nitro group; a trifluoromethyl group; an amido group (for example, an acetamide group and a benzamido group); a carbamoyl group (for example, a methylcarbamoyl group, a butylcarbamoyl group, and a phenylcarbamoyl group; an alkyloxycarbonyl group (for example, an ethyloxycarbonyl group and an isopropyloxycarbonyl group); an aryloxycarbonyl group (for example, a phenyloxycarbonyl group); a carbonyloxy group (for example, a methylcarbonyloxy group, a propylcarbonyloxy group, and a phenylcarbonyloxy group); a cyano group; a halogen atom (a chlorine atom, a bromine atom, a iodine atom, and a fluorine atom); an alkoxy group (for example, a methoxy group, and a butoxy group); an aryloxy group (for example, a phenoxy group); a sulfonyl group (for example, a methanesulfonyl group and a p-toluenesulfonyl group); a sulfonamido group (for example, a methanesulfonamido group, a dodecylsulfonamido group, and a p-toluenesulfonamido group); a sulfamoyl group (for example, a methylsulfamoyl group and a phenylsulfamoyl group); an amino group; an alkylamino group (for example, an ethylamino group, a dimethylamino group, and a hydroxyamino group). When there are at least two $=CR_{91}$—, $R_{91}$ may be different from each other, and a plurality of $=CR_{91}$— may bond to each other to form a condensation ring.

In Formula 2, $X_1$ represents —$NR_{21}$— or —O—; $X_2$, $X_3$, and $X_4$ each represents $=CR_{22}$— or =N—; both $R_{21}$ and $R_{22}$ represent a hydrogen atom or a substituent (for example, an alkyl group such as a methyl group, an ethyl group, an isopropyl group, a hydroxyethyl group, a stearyl group, a dodecyl group, an eicocyl group, a dococyl, and an oleyl group; a cycloalkyl group such as a cyclopropyl group, and a cyclohexyl group; and an aryl group such as a phenyl group, a p-tetradecanyloxypenyl group, an o-octadecanylaminophenyl group, a naphthyl group, and a hydroxyphenyl group) may form a condensation ring with $X_1$, $X_2$, $X_3$, and $X_4$, and however, all of $X_1$, $X_2$, $X_3$, and $X_4$ are not =N—.

In Formula 3, $Y_1$, $Y_2$, $Y_3$, $Y_4$, and $Y_5$ each represent =N— or $=CR_{31}$— wherein $R_{31}$ represent a hydrogen atom or a substituent (for example, an alkyl group such as a methyl group, an ethyl group, an isopropyl group, a cyclohexyl group, a hydroxyethyl group, a stearyl group, a dodecyl group, an eicocyl group, a dococyl, and an oleyl group; a cycloalkyl group such as a cyclopropyl group, and a cyclohexyl group; and an aryl group such as a phenyl group, a p-tetradecanyloxypenyl group, an o-octadecanylaminophenyl group, a naphthyl group, and a hydroxyphenyl group. However, any one of $Y_1$, $Y_3$ and $Y_5$ is not =N—.

In Formula 4, Q represents a group of atoms necessary for forming a 5-membered or 6-membered heterocyclic ring comprising at least one of —O—, —S—, —N<, —$SO_2$—, —CO—, or —$NR_{31}$CO—, wherein $R_{31}$ represent a hydrogen atom or a substituent (for example, an alkyl group such as a methyl group, an ethyl group, an isopropyl group, a hydroxyethyl group, a stearyl group, a dodecyl group, an eicocyl group, a dococyl, and an oleyl group; a cycloalkyl group such as a cyclopropyl group, and a cyclohexyl group; and an aryl group such as a phenyl group, a p-tetradecanyloxypenyl group, an o-octadecanylaminophenyl group, a naphthyl group, and a hydroxyphenyl group.

In Formula 5, G represents an oxygen atom and a sulfur atom, and W represents a group of atoms necessary to form a 5-membered or 6-membered ring along with —S—S—C(=G)—and may have a substituent which may form a ring along with W. Said rings include an aryl group such as a phenyl group, a p-tetradecanyloxypenyl group, an o-octadecanylaminophenyl group, a naphthyl group, and a hydroxyphenyl group. Said substituents include an alkyl group such as a methyl group, an ethyl group, an isopropyl group, a hydroxyethyl group, a stearyl group, a dodecyl group, an eicocyl group, a dococyl, and an oleyl group; a cycloalkyl group such as a cyclopropyl group and a cyclohexyl group; a hydroxy group; a carboxy group; a nitro group; a trifluoromethyl group; an amido group such as acetamido group, and a benzamido group; a carbamoyl group such as a methylcarbamoyl group, a butylcarbamoyl group, and a phenylcarbamoyl group; an alkyloxycarbonyl group such as an ethyloxycarbonyl group and an isopropyloxycarbonyl group; an aryloxycarbonyl group such as a phenyloxycarbonyl group; a carbonyloxy group such as a methyl carbonyloxy group, a propylcarbonyloxy group, and a phenylcarbonyloxy group; a cyano group; a halogen atom such as a chlorine atom, bromine atom, an iodine atom, and a fluorine atom; an alkoxy group such as a methoxy group, an ethoxy group, and a butoxy group; an aryloxy group such as a phenoxy group; a sulfonyl group such as a methanesulfonyl group and a p-toluenesulfonyl group; a sulfonamido group such as a methanesulfonamido group, a dodecylsulfonamido group, and a p-toluenesulfonamido group; a sulfamoyl group such as a methylsulfamoyl group and a phenylsulfamoyl group; an amino group; an alkylamino group such as an ethylamino group, dimethylamino group, and a hydroxyamino group.

In Formula 6, $R_{61}$ represents a substituent. Said substituents include an alkyl group such as a methyl group, an ethyl group, an isopropyl group, a hydroxyethyl group, a stearyl group, a dodecyl group, an eicocyl group, a dococyl, and an oleyl group; a cycloalkyl group such as a cyclopropyl group, and a cyclohexyl group; an aryl group such as a phenyl group, a p-tetradecanyloxypenyl group, an o-octadecanylaminophenyl group, a naphthyl group, and a hydroxyphenyl group; an aryl group such as a phenyl group, a p-tetradecanyloxypenyl group, an o-octadecanylaminophenyl group, a naphthyl group, and a hydroxyphenyl group, a hydroxy group; a carboxy group; a nitro group; a trifluoromethyl group; an amido group such as acetamido group and a benzamido group; a carbamoyl group such as a methylcarbamoyl group, a butylcarbamoyl group, and a phenylcarbamoyl group; an alkyloxycarbonyl group, such as an ethyloxycarbonyl group and an isopropyloxycarbonyl group; an aryloxycarbonyl group such as a phenyloxycarbonyl group; a carbonyloxy group such as a methylcarbonyloxy group, a propylcarbonyloxy group, and a phenylcarbonyloxy group; a cyano group; a halogen atom such as a chlorine atom, bromine atom, an iodine atom, and a fluorine atom, an alkoxy group such as a methoxy group, an ethoxy group and a butoxy group; an aryloxy group such as a phenoxy group; a sulfonyl group such as a methanesulfonyl group and p-toluenesulfonyl group; a sulfonamido group such as a methanesulfonamido group, a dodecylsulfonamido group, and a p-toluenesulfonamido group; a sulfamoyl group such as a methylsulfamoyl group, and a phenylsulfamoyl group; an amino group; an alkylamino group such as an ethylamino group, dimethylamino group, and a hydroxyamino group. When $m_6$ is 2 or more, $R_{61}$ may be a different group and may combine with each other to from a condensation ring.

In Formula 6-2, $R_{62}$ represents a substituent. Said substituents include an alkyl group having at least 2 carbon atoms such as an ethyl group, an isopropyl group, a cyclohexyl group, a hydroxyethyl group, a stearyl group, a dodecyl group, an eicocyl group, a dococyl, and an oleyl group; an aryl group such as a phenyl group, a p-tetradecanyloxypenyl group, an o-octadecanylaminophenyl group, a naphthyl group, and a hydroxyphenyl group; an aryl group such as a phenyl group, a p-tetradecanyloxypenyl group, an o-octadecanylaminophenyl group, a naphthyl group, and a hydroxyphenyl group; a hydroxy group; a carboxy group; a nitro group; a trifluoromethyl group; an amido group such as acetamido group and a benzamido group; a carbamoyl group such as a methylcarbamoyl group, a butylcarbamoyl group, and a phenylcarbamoyl group; an alkyloxycarbonyl group, such as an ethyloxycarbonyl group and an isopropyloxycarbonyl group; an aryloxycarbonyl group such as a phenyloxycarbonyl group; a carbonyloxy group such as a methylcarbonyloxy group, a propylcarbonyloxy group, and a phenylcarbonyloxy group; a cyano group; a halogen atom such as a chlorine atom, bromine atom, an iodine atom, and a fluorine atom; an alkoxy group such as a methoxy group, an ethoxy group, and a butoxy group; an aryloxy group such as a phenoxy group; a sulfonyl group such as a methanesulfonyl group and p-toluenesulfonyl group; a sulfonamido group such as a methanesulfonamido group, a dodecylsulfonamido group, and a p-toluenesulfonamido group; a sulfamoyl group such as a methylsulfamoyl group and a phenylsulfamoyl group, an amino group; an alkylamino group such as an ethylamino group, a dimethylamino group and a hydroxyamino group. When $m_{62}$ is 2 or more, $R_{62}$ may be a different group and may bond to each other to form a condensation ring.

In Formula 7, $R_{71}$ represents the same as $R_{61}$.

In Formula 7-2, $R_{72}$ represents the same as $R_{61}$.

In Formula 8, $R_{81}$ represents the same as $R_{61}$.

In Formula 9, $R_{91}$ represents the same as $R^{61}$.

In Formula 10, Ra and Rb each represent an electron attractive group which includes a carboxy group; a nitro group; a trifluoromethyl group; a carbamoyl group such as a methylcarbamoyl group, a butylcarbamoyl group, and a phenylcarbamoyl group; an alkyloxycarbonyl group such as an ethyloxycarbonyl group and an isopropyloxycarbonyl group; an aryloxycarbonyl group such as a phenyloxycarbonyl group; a cyano group; a halogen atom such as a chlorine atom, a bromine atom, an iodine atom, and a fluorine atom; a sulfonyl group such as a methanesulfonyl group, and a p-toluenesulfonyl group; a carbonyloxy group such as a methylcarbonyloxy group and a propylcarbonyloxy group; an alkylcarbonyl group such as a methylcarbonyl group and a phenylcarbonyl group.

In Formula 11, $R_{11}$ represents the same as $R_{61}$.

In Formula 12, $R_{12}$ represents the same as $R_{61}$.

In Formula 13, $R_{13}$ represents the same as $R_{61}$.

In Formula 14, $R_{14}$ represents the same as $R_{61}$.

Agents which promote adsorption onto silver halide grains include groups derived from cyclic or chain thioethers (for example, dimethyl sulfide, methyl sulfide, methyl phenyl sulfide, and thiocrown ethers), groups derived from aliphatic mercaptans (for example, groups derived from methylmercaptan, and propylmercaptan), groups derived from aromatic mercaptans (for example, thiophenol, and thionaphthol), and, groups derived from cyclic or chain thioamides, groups derived from cyclic or chain thioureids, groups derived from heterocyclic mercaptans (when a nitrogen atom is adjacent to a carbon atom which is bonded to an —SH group, said groups are the same as cyclic thioamido groups which is in the relationship of tautomers, and the specific examples of said groups are the same as those listed above), groups derived from azoles capable of forming silver imide, groups derived from nitrogen-containing aromatic cyclic quaternary salts (for example, N-methylpyridinium salt, and N-ethylquinolium salt). Of these, preferred are groups derived from thioamide, thioureido, aromatic mercaptans, heterocyclic mercaptans or azoles capable of forming silver imide, but more preferred are groups derived from heterocyclic mercaptans or azoles capable of forming silver imide.

Specific examples of groups, derived from heterocyclic mercaptans and derived from azoles capable of forming silver imide, include those derived from heterocyclic mercaptans such as mercaptotetrazole, 3-mercapto-1,2,4-triazole, 2-mercapto-1,3,4-oxadiazole, 2-mercapto-1,3,4-thisdiazole, 2-mercaptoimidazole, 2-mercapto-1,3-oxazole, 2-mercapto-1,3-thiazole, 2-mercaptobenzimidazole, 2-mercaptobenzoxazole, 2-mercaptobenzthiazole, 2-mercaptopyridine, 2-mercaptopyrimidine, and mercaptotriazine, and derived from azoles capable of forming silver imide such as benzotriazole, triazole, tetrazole, indazole, benzimidazole, imidazole, tetraazaindene, indazole, and purine. Of these, preferred are groups derived from mercaptotetrazole, 3-mercapto-1,2,4-triazole, 2-mercapto-1,3,4-oxadiazole, 2-mercapto-1,3,4-thiadiazole, 2-mercaptobenzimidazole, 2-mercaptobenzozazole, 2-mercaptobenzothiazole, 2-mercaptopyrimidine, mercaptotriazine, benzotriazole, and triazole, however more preferred are groups derived form mercaptotetrazole, 3-mercapto-1,2,4-triazole, 2-mwercapto-1,3,4-thiadiazole, 2-mercaptobenzimidazole, 2-mercaptobenzothiazole, benzotriazole, tetrazole, and still more preferably employed are groups derived from mercaptotetrazole, 2-mercapto-1,3,4-thiadiazole and benzotriazole Spefici examples of compounds of the present invention will now be illustrated below. However, the present invention is not limited to these examples.

2-1

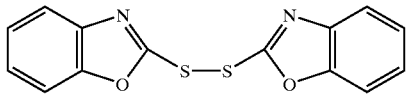

2-2

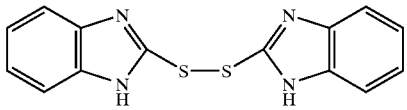

2-3

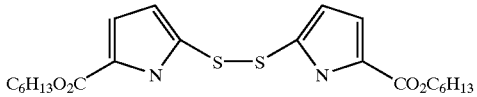

2-4

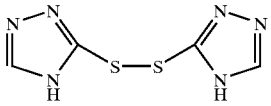

2-5

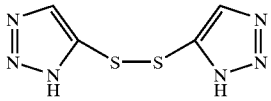

2-6

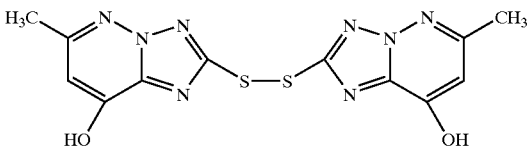

2-7

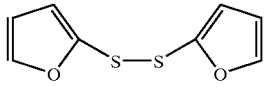

2-9

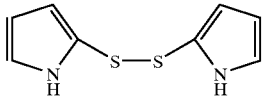

2-10

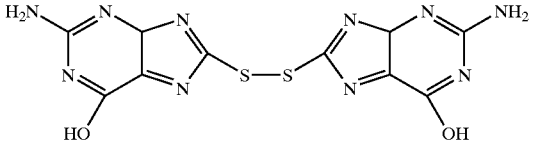

2-12

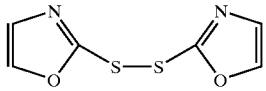

2-14

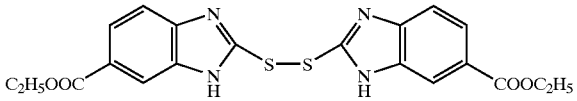

2-16

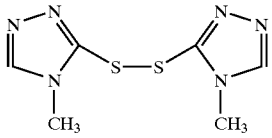

2-17

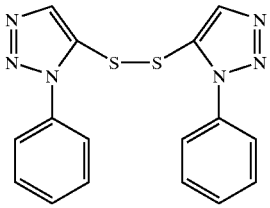

2-18

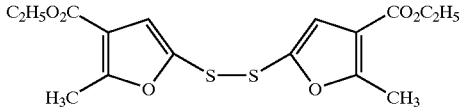

2-19

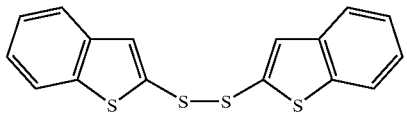

2-20

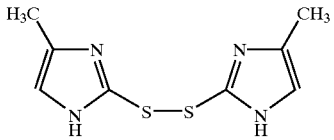

2-21

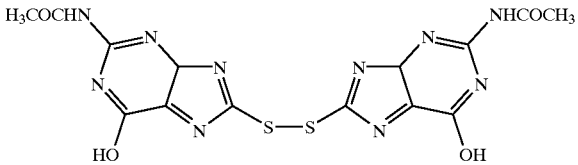

2-22

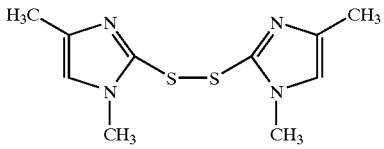

-continued
3-1
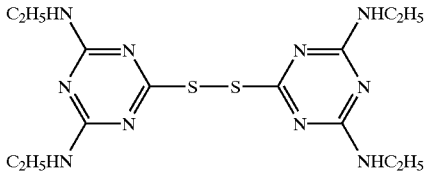
3-2
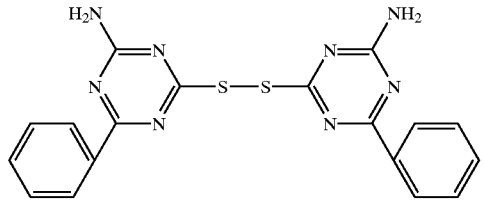
3-3
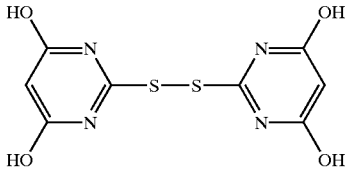
3-4
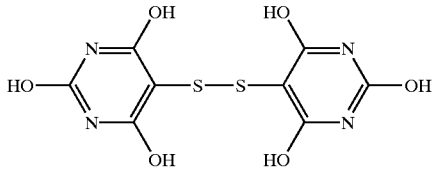
3-5
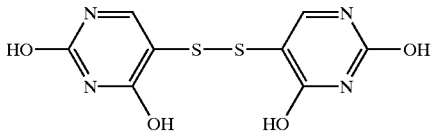
3-6
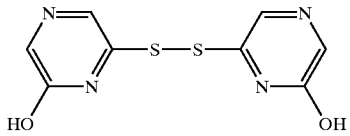
3-7
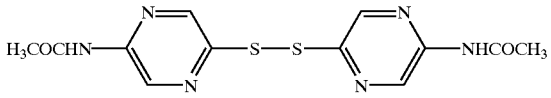
3-8
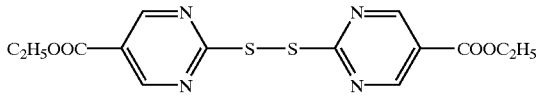
3-9
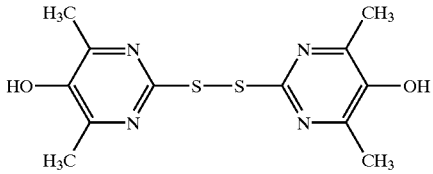
4-1
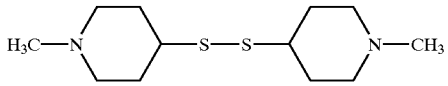
4-2
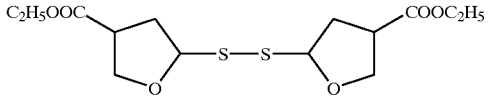
4-3
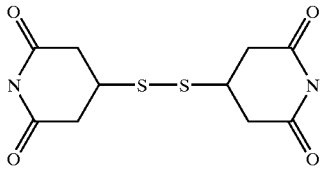
4-4
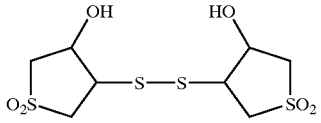
4-5
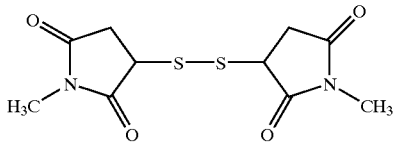
4-6
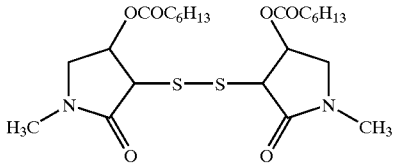
4-7
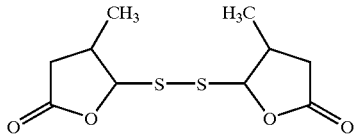
4-8
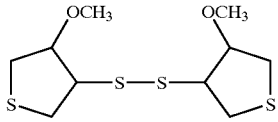
4-9
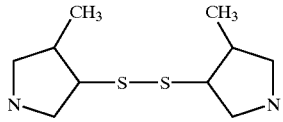

-continued
5-1
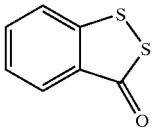
5-2
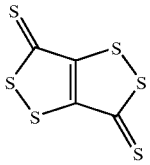
5-3
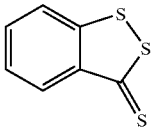
5-4
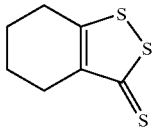
5-5
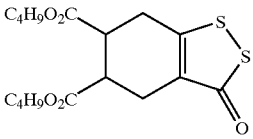
5-6
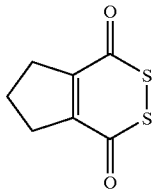
5-7
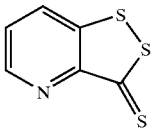
5-8
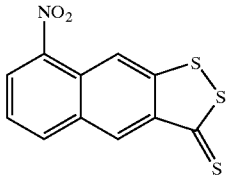
5-9
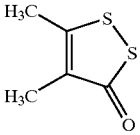
6-1
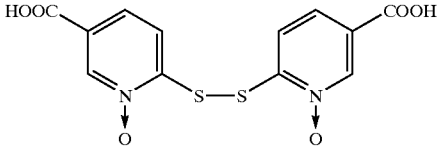
6-2
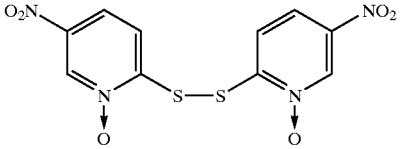
6-3
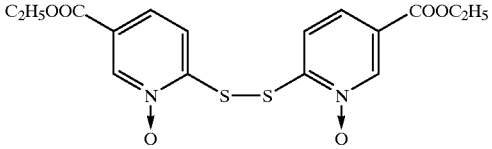
6-4
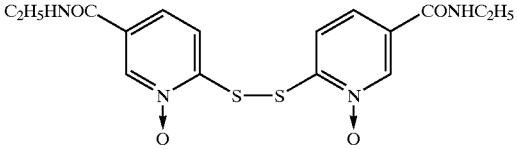
6-5
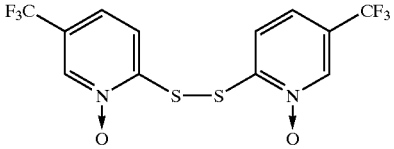
6-6
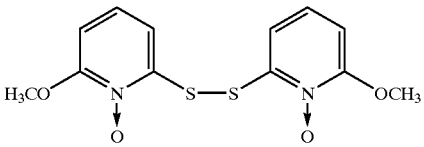
6-7
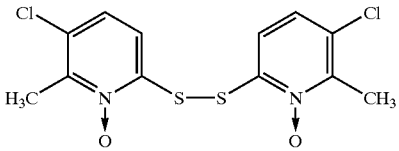
6-8
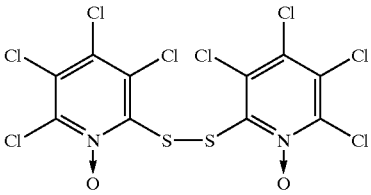
6-9
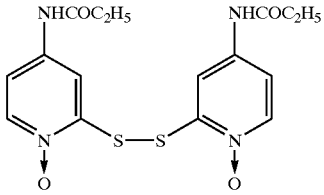

-continued
6-10
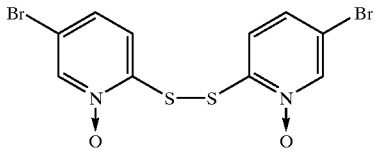
6-11
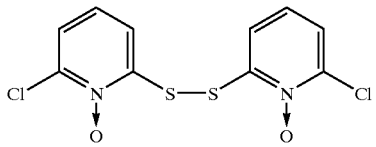
6-12
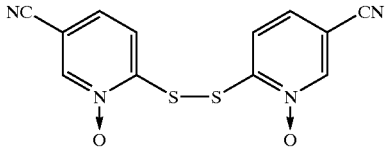
6-13
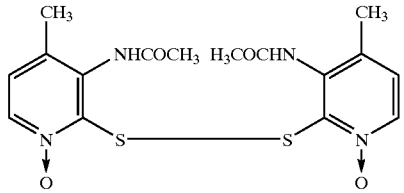
6-14
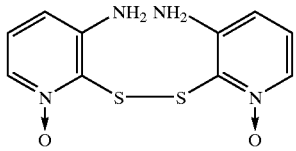
6-15
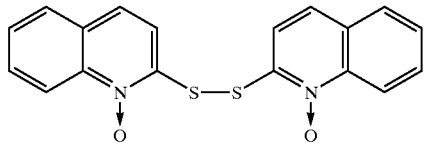
6-16
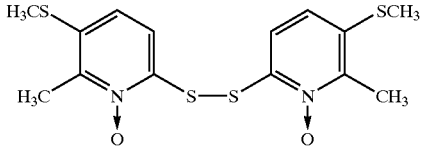
6-17
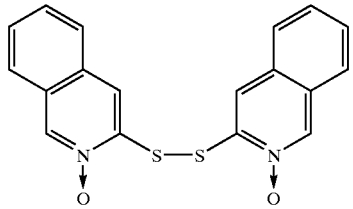
6-18
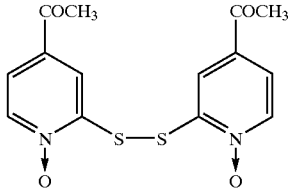
7-1
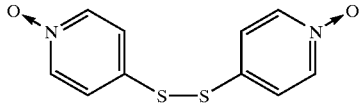
7-2
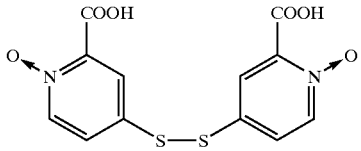
7-3
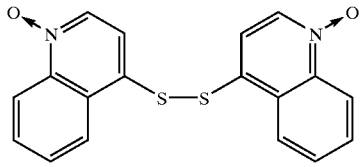
7-4
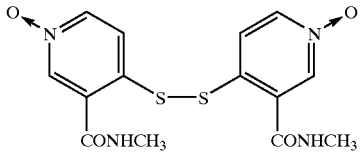
7-5
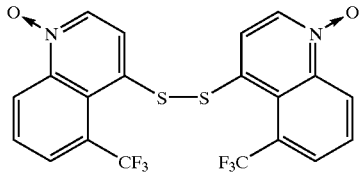
7-6
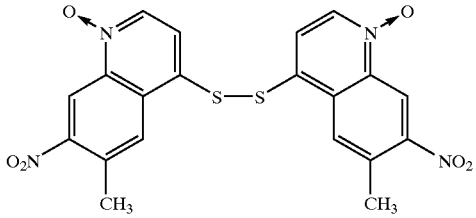
7-7
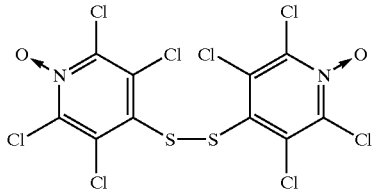

-continued
7-8
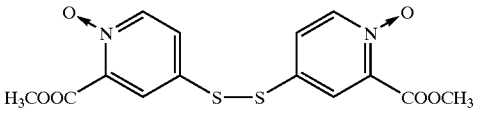
7-9
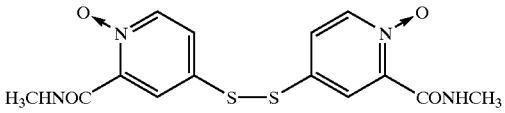
8-1
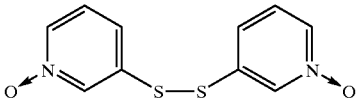
8-2
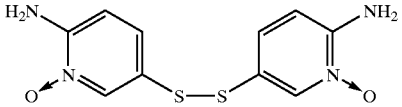
8-3
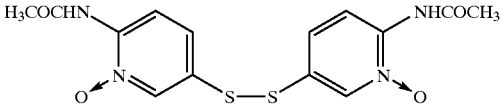
8-4
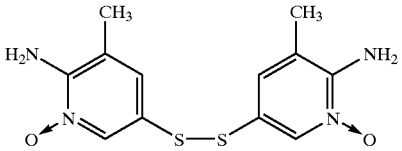
8-5
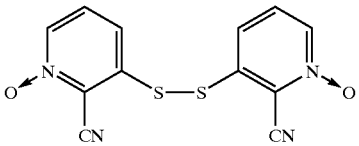
8-6
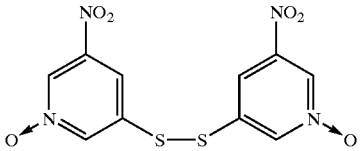
8-7
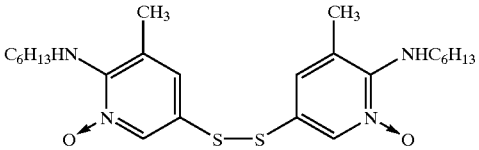
8-8
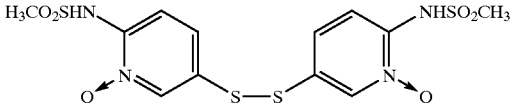
8-9
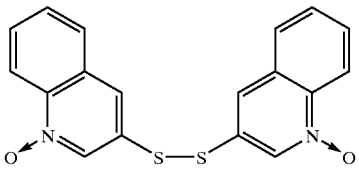
9-1
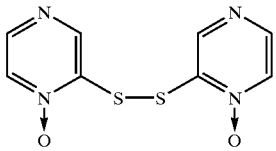
9-2
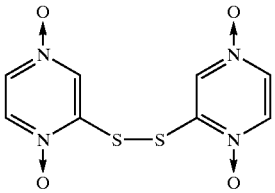
9-3
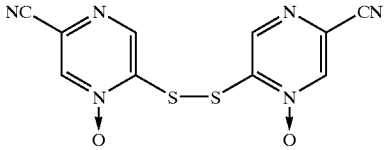
9-4
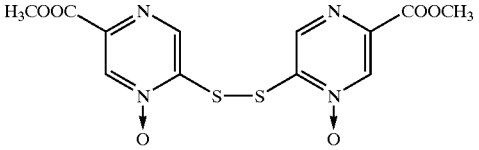
9-5
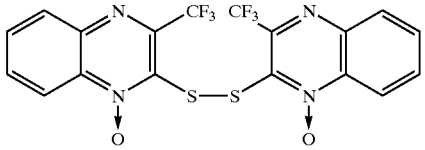
9-6
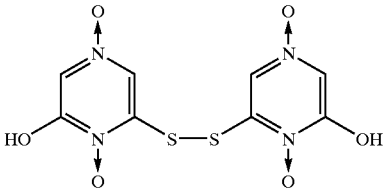
9-7
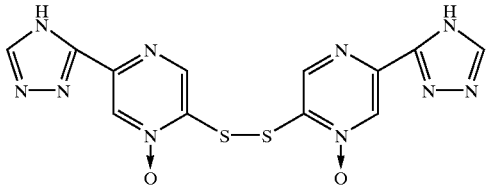

-continued
9-8
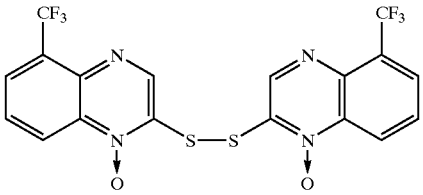
9-9
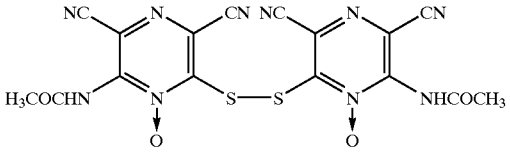
9-10
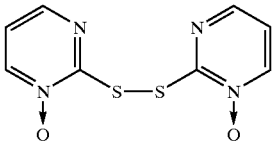
9-11
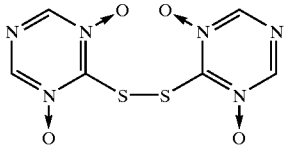
9-12
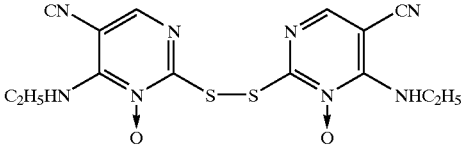
9-13
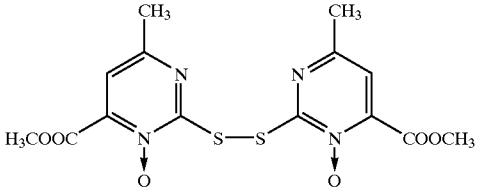
9-14
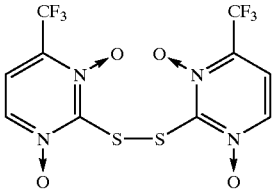
9-15
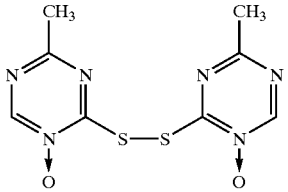
9-16
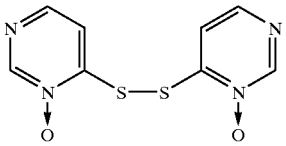
9-17
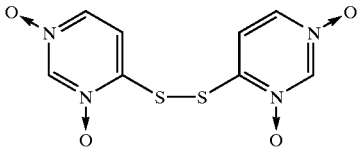
9-18
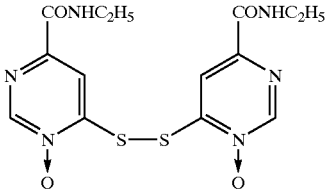
9-19
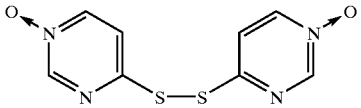
9-20
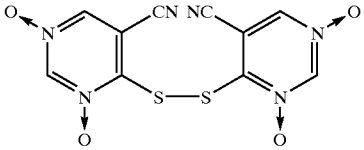
9-21
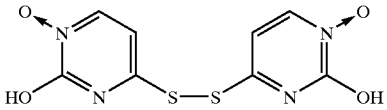
9-22
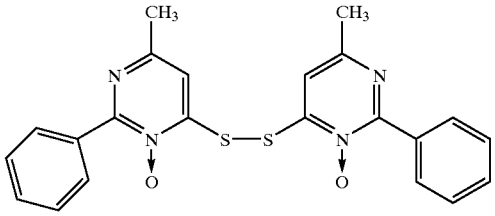
9-23
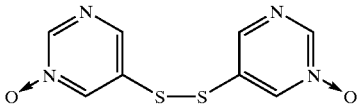

-continued
9-24
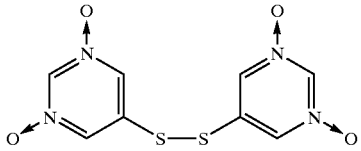
9-25
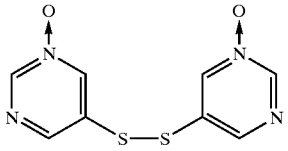
9-26
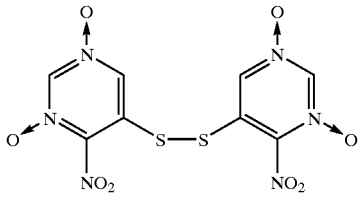
9-27
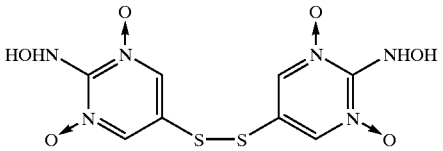
9-28
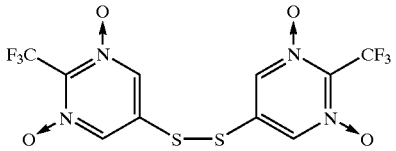
9-29
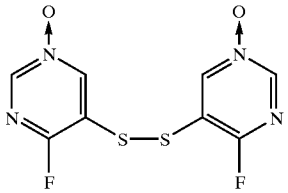
9-30
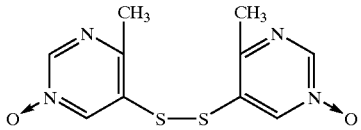
9-31
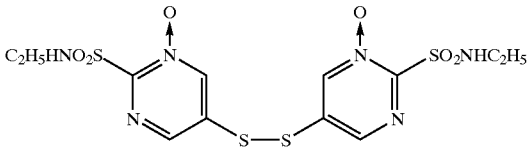
9-27
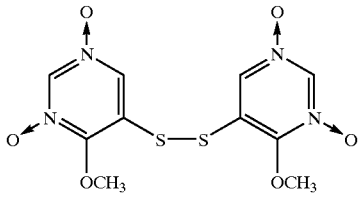
10-1
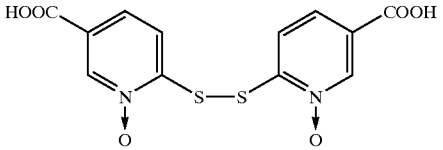
10-2
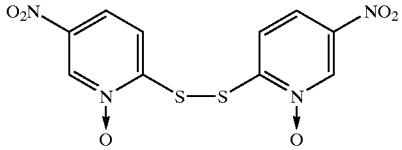
10-3
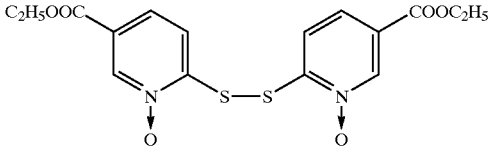
10-4
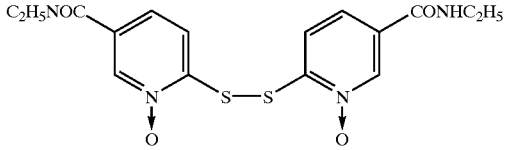
10-5
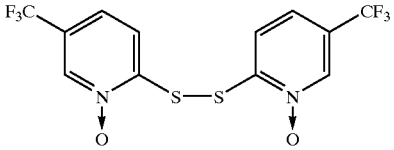
10-6
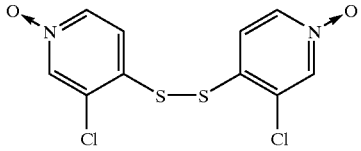
10-7
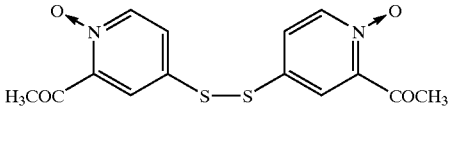
10-8
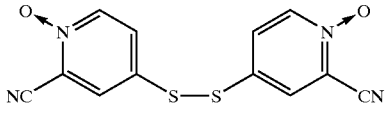
10-9
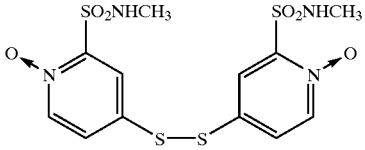

-continued
10-10
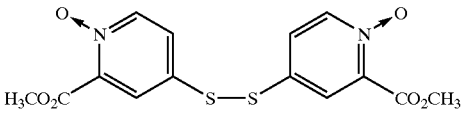
10-11
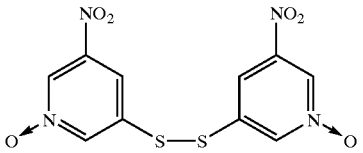
10-12
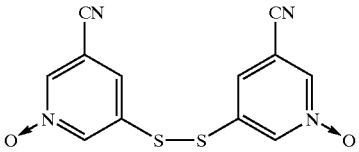
10-13
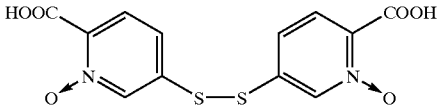
10-14
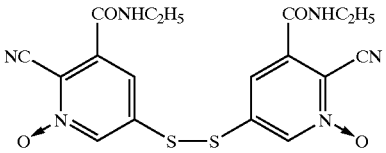
10-15
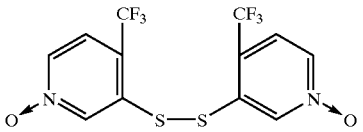
10-16
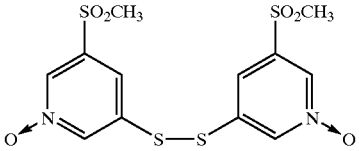
10-17
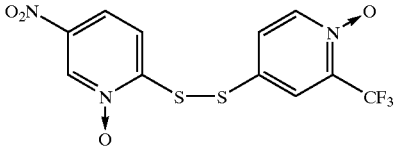
11-1
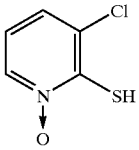
11-2
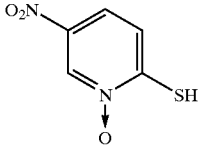
11-3
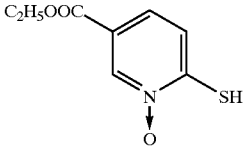
11-4
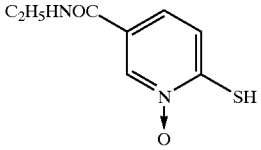
11-5
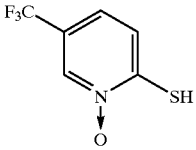
11-6
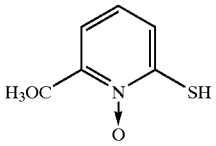
11-7
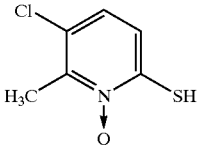
11-8
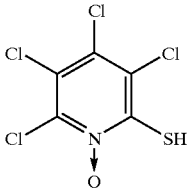
11-9
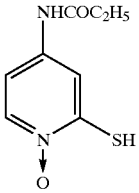
11-10
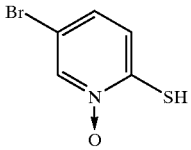

-continued
11-11
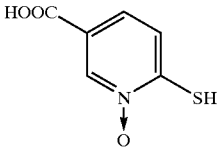
11-12
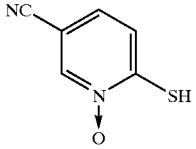
11-13
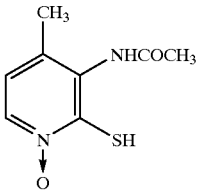
11-14
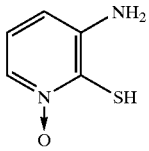
11-15
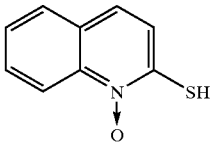
11-16
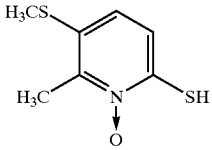
11-17
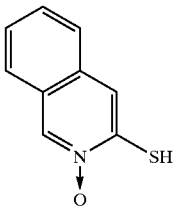
11-18
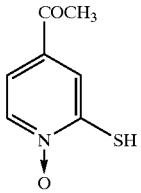
12-1
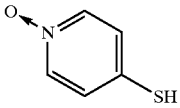
12-2
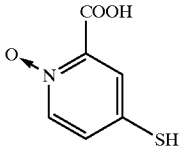
12-3
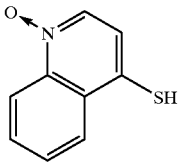
12-4
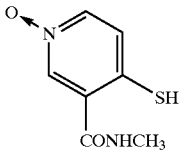
12-5
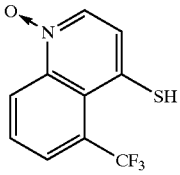
12-6
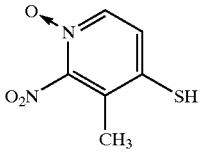
12-7
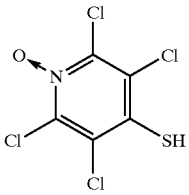
12-8
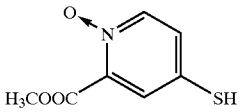
12-9
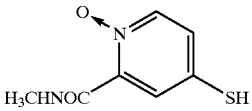
13-1
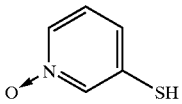

-continued
13-2
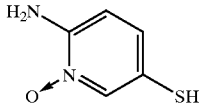
13-3
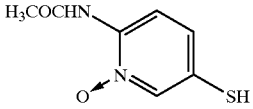
13-4
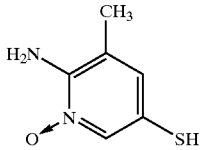
13-5
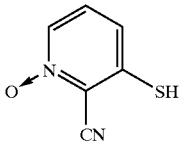
13-6
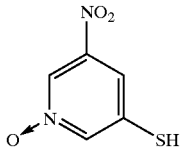
13-7
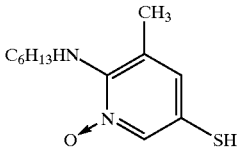
13-8
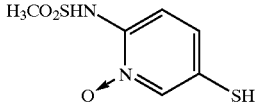
13-9
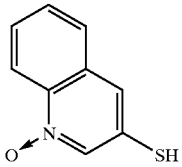
14-1
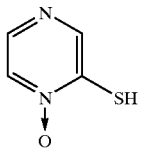
14-2
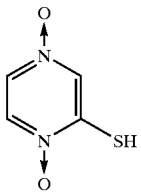
14-3
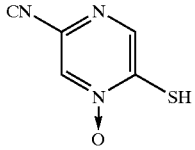
14-4
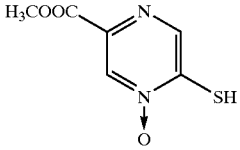
14-5
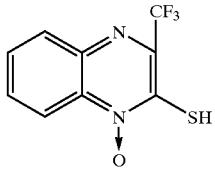
14-6
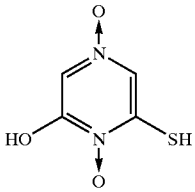
14-7
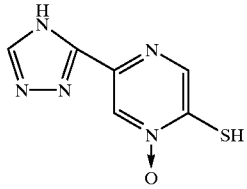
14-8
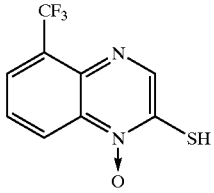
14-9
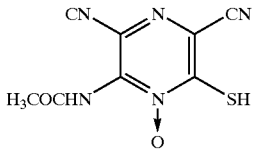
14-10
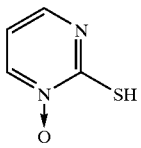

-continued
14-11
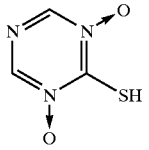
14-12
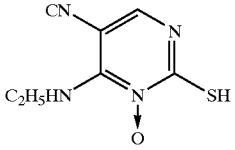
14-13
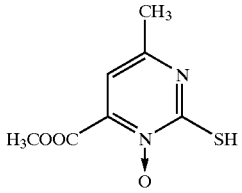
14-14
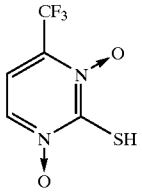
14-15
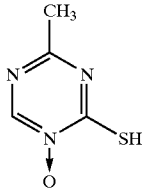
14-16
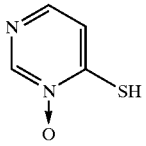
14-17
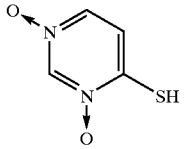
14-18
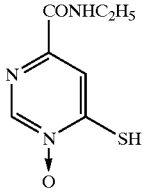
14-19
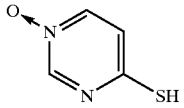
14-20
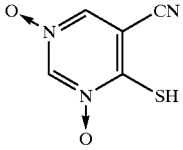
14-21
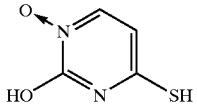
14-22
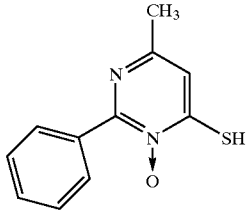
14-23
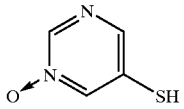
14-24
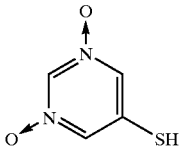
14-25
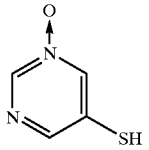
14-26
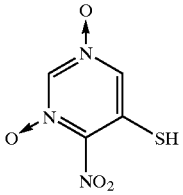

-continued
14-27
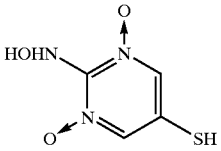
14-28
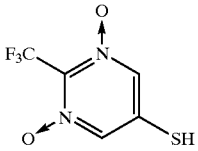
14-29
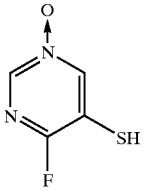
14-30
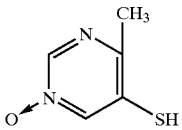
14-31
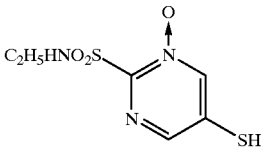
14-32
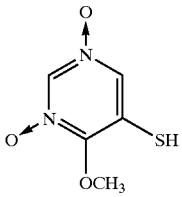
15-1
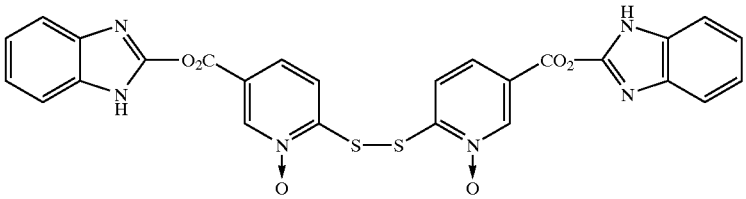
15-2
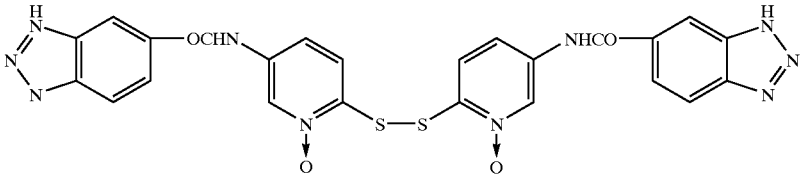
15-3
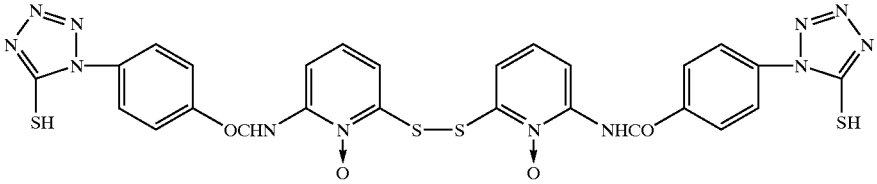
15-4
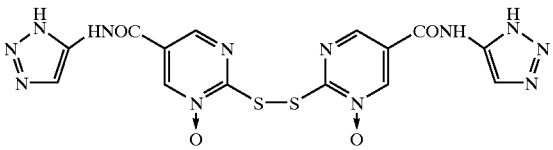
15-5
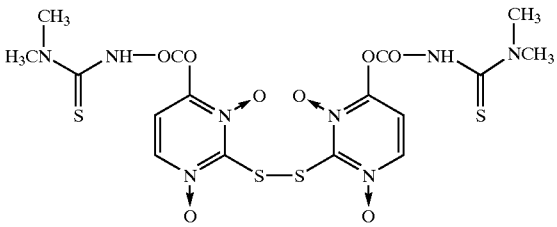

-continued
15-6
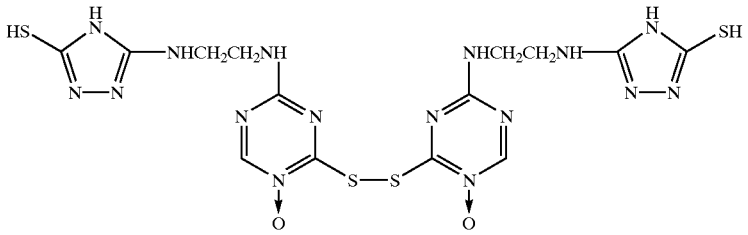
15-7
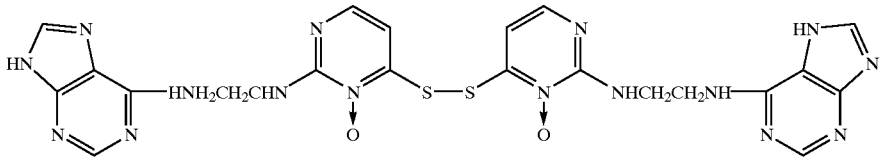
15-8
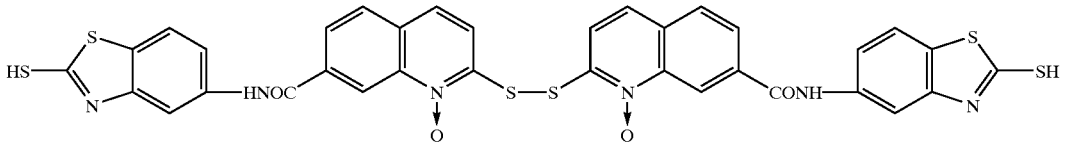
15-9
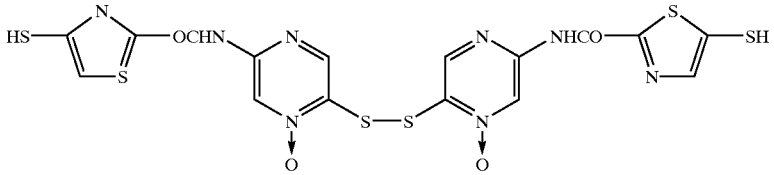
15-10
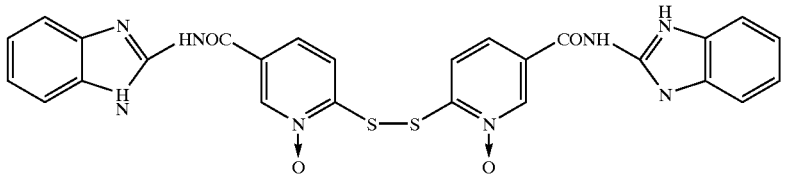
15-11
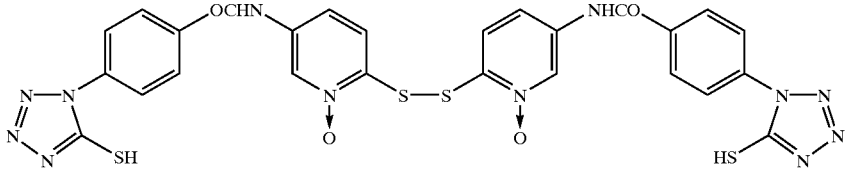
15-12
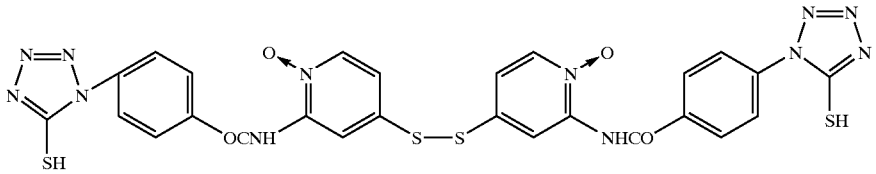

Synthesis examples of the compounds of the present invention will now be described.

<Synthesis of Compound 6-2>

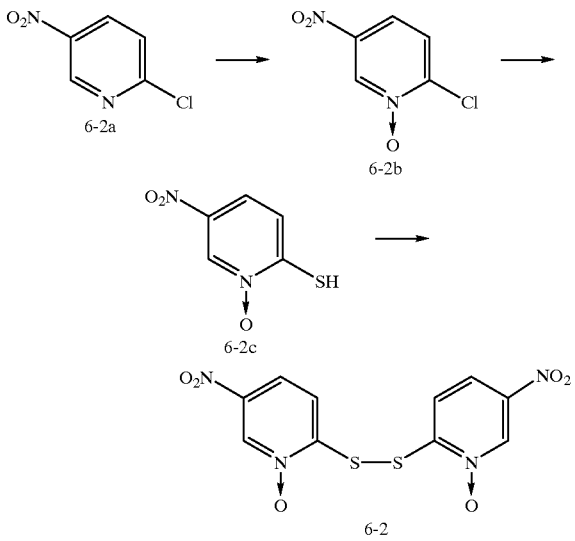

5.0 g of Compound 6-2a were dissolved in 50 ml of dichloromethane, and 6.2 g of urea peroxide were added. The resulting mixture was cooled to 0° C. and 13.2 g of trifluoroacetic anhydride were slowly added dropwise. The resulting mixture was stirred for 30 minutes as it was, and then heated to room temperature. When the reaction was completed, an aqueous sodium sulfite solution was added to decompose excess peroxides. The resulting mixture was poured into a 0.5 mole/liter aqueous hydrochloric acid solution. Subsequently, extraction was carried out utilizing dichloromethane, and the resulting extract was washed with an aqueous sodium hydrogencarbonate solution, and then dried utilizing magnesium sulfate. Then, solvents were removed under reduced pressure. The resulting suspension was washed with acetonitrile and filtered, whereby 4.5 g (a yield of 82 percent) of Compound 6-2b were obtained. The structure was identified utilizing NMR and mass spectra.

Then, 4.0 g of Compound 6-2b were dissolved in 50 ml of ethanol and 2.6 g of sodium hydrosulfide were added. The resulting mixture was heated to 100° C. while stirring. After the completion of the reaction, the solvent was removed under reduced pressure, and the resulting residue was dissolved in water. The resulting solution was acidified utilizing acetic acid, whereby precipitates were formed. The resulting precipitates were collected by filtration, and 3.5 g (a yield of 89 percent) of Compound 6-2c was obtained. The structure was identified utilizing NMR and mass spectra.

Subsequently, 3.0 g of Compound 6-2c were subjected to suspension in water and then heated to 40° C. Subsequently, 2.3 g of a 30 percent aqueous hydrogen peroxide solution were added dropwise while maintaining a temperature no higher than 50° C. The reaction mixture was stirred at 45° C. After setting aside the resulting reaction mixture over night in a refrigerator at 5° C., crystals were collected employing filtration and then washed with chilled methanol, whereby 2.3 g (a yield of 78 percent) of Compound 6-2 were obtained. The structure was identified utilizing NMR and mass spectra.

<Synthesis of Compound 7-2>

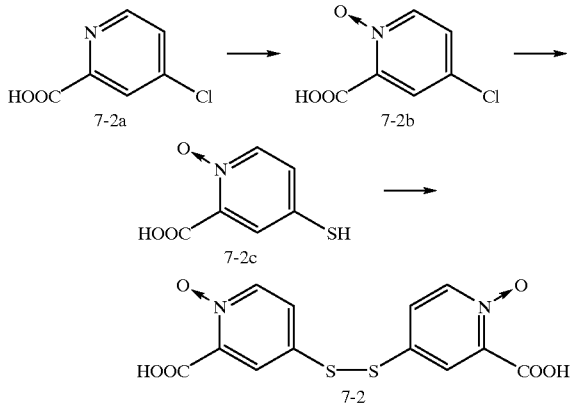

5.0 g of Compound 7-2a were dissolved in 50 ml of dichloromethane, and 6.3 g of urea peroxide were added. The resulting mixture was cooled to 0° C. whereupon 13.2 g of trifluoroacetic anhydride were slowly added dropwise. The resulting mixture was stirred for 30 minutes as it was, and then heated to room temperature. When the reaction was completed, an aqueous sodium sulfite solution was added to decompose excess peroxides. The resulting mixture was poured into a 0.5 mole/liter aqueous hydrochloric acid solution. Subsequently, extraction was carried out utilizing dichloromethane, and the resulting extract was washed with an aqueous sodium hydrogencarbonate solution, and then dried utilizing magnesium sulfate. Solvents were then removed under reduced pressure. The resulting product was washed with acetonitrile and filtered, whereby 4.4 g (a yield of 80 percent) of Compound 7-2b were obtained. The structure was identified utilizing NMR and mass spectra.

Then, 4.0 g of Compound 7-2b were dissolved in 50 ml of ethanol and 2.6 g of sodium hydrosulfide were added. The resulting mixture was heated to 100° C. while stirring. After the completion of the reaction, the solvent was removed under reduced pressure, and the resulting residue was dissolved in water. The resulting solution was acidified utilizing acetic acid, whereby precipitates were formed. The resulting precipitates were collected by filtration, and 2.9 g (a yield of 89 percent) of Compound 7-2c was obtained. The structured was identified utilizing NMR and mass spectra.

Subsequently, 2.0 g of Compound 7-2c were subjected to suspension in water and then heated to 40° C. Subsequently, 2.0 g of a 30 percent aqueous hydrogen peroxide solution were added dropwise while maintaining a temperature no higher than 50° C. The resulting mixture was stirred at 45° C. After setting aside said resulting reaction mixture overnight in a refrigerator at 5° C., crystals were collected employing filtration and then washed with chilled methanol, whereby 2.3 g (a yield of 80 percent) of Compound 7-2 were obtained. The structure was identified utilizing NMR and mass spectra.

<Synthesis of Compound 8-3>

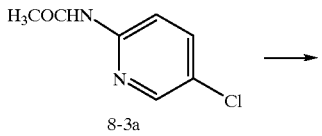

-continued

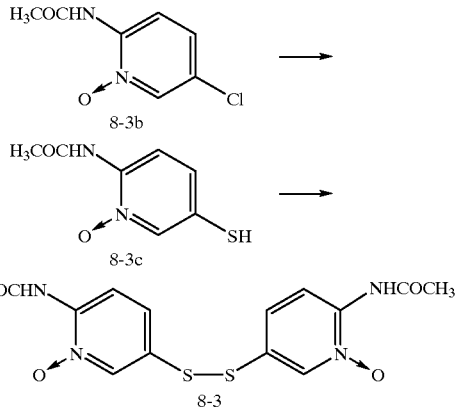

5.0 g of Compound 8-3a were dissolved in 50 ml of dichloromethane, and 5.8 g of urea peroxide were added. The resulting mixture was cooled to 0° C. and 13.2 g of trifluoroacetic anhydride were slowly added dropwise. The resulting mixture was stirred for 30 minutes as it was, and then heated to room temperature. When the reaction was completed, an aqueous sodium sulfite solution was added to decompose excess peroxides. The resulting mixture was poured into a 0.5 mole/liter aqueous hydrochloric acid solution. Subsequently, extraction was carried out utilizing dichloromethane, and the resulting extract was washed with an aqueous sodium hydrogencarbonate solution, and then dried utilizing magnesium sulfate. Solvents were then removed under reduced pressure. The resulting product was washed with acetonitrile and filtered, whereby 4.6 g (a yield of 85 percent) of Compound 8-3b were obtained. The structure was identified utilizing NMR and mass spectra.

Then, 4.0 g of Compound 8-3b were dissolved in 50 ml of ethanol and 2.4 g of sodium hydrosulfide were added. While stirring, the resulting mixture was heated to 100° C. After the completion of the reaction, the solvent was removed under reduced pressure, and the resulting residue was dissolved in water. The resulting solution was acidified utilizing acetic acid, whereby precipitates were formed. The resulting precipitates were collected by filtration, and 2.7 g (a yield of 68 percent) of Compound 8-3c was obtained. The structure was identified utilizing NMR and mass spectra.

Subsequently, 2.5 g of Compound 8-3c were subjected to suspension in water and then heated to 40° C. Subsequently, 1.7 g of a 30 percent aqueous hydrogen peroxide solution were added dropwise while maintaining a temperature no higher than 50° C. The resulting mixture was stirred while maintaining 45° C. After setting aside the resulting reaction mixture overnight in a refrigerator at 5° C., crystals were collected employing filtration and then washed with chilled methanol, whereby 2.1 g (a yield of 87 percent) of Compound 8-3 were obtained. The structure was identified utilizing NMR and mass spectra.

<Synthesis of Compound 9-1>

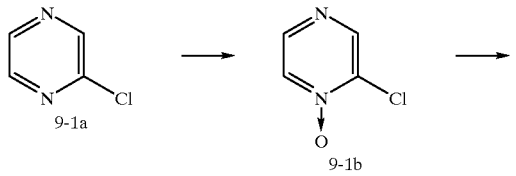

-continued

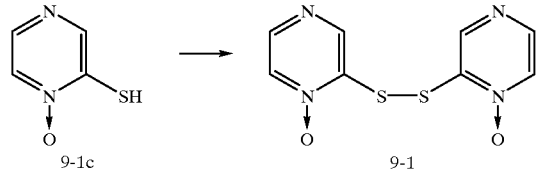

5.0 g of Compound 9-la were dissolved in 50 ml of dichloromethane, and 8.6 g of urea peroxide were added. The resulting mixture was cooled to 0° C. and 18.3 g of trifluoroacetic anhydride were slowly added dropwise. The resulting mixture was stirred for 30 minutes as it was, and then heated to room temperature. When the reaction completed, an aqueous sodium sulfite solution was added to decompose excess peroxides. The resulting mixture was poured into a 0.5 mole/liter aqueous hydrochloric acid solution. Subsequently, extraction was carried out utilizing dichloromethane, and the resulting extract was washed with an aqueous sodium hydrogencarbonate solution, and then dried utilizing magnesium sulfate. Then, any remaining solvents were removed under reduced pressure. The resulting product was washed with acetonitrile and filtered, whereby 4.8 g (a yield of 84 percent) of Compound 9-1b were obtained. The structure was identified utilizing NMR and mass spectra.

Then, 4.0 g of Compound 9-1b were dissolved in 50 ml of ethanol and 3.4 g of sodium hydrosulfide were added. The resulting mixture was heated to 100° C. while stirring. After the completion of the reaction, the solvent was removed under reduced pressure, and the resulting residue was dissolved in water. The resulting solution was acidified utilizing acetic acid, whereby precipitates were formed. The resulting precipitates were collected by filtration, and 3.3 g (a yield of 85 percent) of Compound 9-1c were obtained. The structure was identified utilizing NMR and mass spectra.

Subsequently, 3.0 g of Compound 9-1c were subjected to suspension in water and then heated to 40° C. Subsequently, 3.3 g of a 30 percent aqueous hydrogen peroxide solution were added dropwise while maintaining a temperature no higher than 50° C. The resulting mixture was stirred while maintaining 45° C. After setting aside the resulting reaction mixture over night in a refrigerator at 5° C., crystals were collected employing filtration and then washed with chilled methanol, whereby 2.7 g (a yield of 91 percent) of Compound 9-1 were obtained. The structure was identified utilizing NMR and mass spectra.

It is possible to synthesize other compounds employing the same or analogous methods.

The added amount of the compounds represented by Formulas 1 through 14 of the present invention is not particularly limited. However, when added to light-sensitive silver halide emulsion layers, the added amount is preferably in the range from $1.0\times10^{-7}$ to $1.0\times10^{-1}$ mole per mole of AgI of the layer to be added, and is more preferably in the rang from $1.0\times10^{-6}$ to $5.0\times10^{-3}$ mole.

It is also possible to add the compounds represented by Formulas 1 through 14 of the present invention in the form of a solid or a solution. When added in the form of a solution, said compounds may be dissolved in water, in water-soluble solvents, or in mixtures thereof, and the resulting solution may be added. Or said compounds may be subjected to emulsion dispersion, and the resulting dispersion may then be added. When dissolved in water, it is possible to adjust the pH to a high or low value so as to enhance the solubility, and then the resulting solution may be added. Two or more compounds may also be employed in combination.

As reduction sensitization preferably employed in the present invention, it is possible to select any of the methods in which reducing agents, known in the art, are added to silver halide emulsions, in which silver halide grains are subjected to growth or ripening at a low pAg of 1 to 7, which is called silver digestion, or in which silver halide grains are subjected to growth or ripening at a high pH of 8 to 11, which is called high pH ripening. Further, two or more methods may be employed in combination. The light-sensitive materials including the compound represented by Formula 1 are resistive to latent-image regression.

A method, in which reduction sensitizers are added, is preferable one in the point in which it is possible to precisely control the level of reduction sensitization. Reduction sensitizers, known in the art, include stannous salts, amines, polyamine acids, hydrazine derivatives, formamidine-sulfinic acid, silane compounds, and borane compounds. In the present invention, it is possible to employ reduction sensitizers selected from those known in the art and to employ those in combination of two or more types. Preferable reduction sensitizers include stannous chloride, urea dioxide, and dimethylaminoborane. It is necessary to determine the added amount of reduction sensitizers, depending on the emulsion production conditions. However, the added amount is suitably in the range from $10^{-7}$ to $10^{-3}$ mole per mole of silver halide.

It is also possible to preferably employ ascorbic acid and derivatives thereof as the reduction sensitizers employed in the present invention. It is permissible to dissolve reduction sensitizers in water, alcohols, glycols, ketones, esters, or amides, and to add the resulting composition during grain formation, prior to or after chemical sensitization. Said reduction sensitizers may be added during any of the emulsion preparation processes. However, any method, in which addition is carried out during grain growth, is particularly preferred. Reduction sensitizers may also be previously charged into a reaction vessel. However, it is preferable that the addition is carried out at the optimal time during grain growth.

Further, reduction sensitizers may be added in advance to an aqueous water-soluble silver salt or water-soluble alkali halide solution, and grains may be formed employing these aqueous solutions.

Further, any method is preferred in which, along with grain formation, a reduction sensitizer solution is added several times after dividing said solution, or continuously added over a long period of time.

Silver halide grains incorporated into the silver halide emulsion, which has undergone reduction sensitization, preferably employed in the present invention, may have regular crystal structures such as cube, octahedron, tetradecahedron, or irregular crystal forms such as sphere and a tabular form. Of these structures, tabular grains are preferred. Grains having an optional ratio of (100) plane to (111) plane may also be employed. Further, grains having complexes of these crystal forms may be employed, and grains having various crystal forms may be mixed.

Tabular silver halide grains, as described in the present invention, refer to grains having one twin plane or at least two parallel twin planes. The aspect ratio of said grains is commonly 2 or more, and is preferably from 3 to 12.

In the present invention, the average grain diameter of silver halide grains is preferably from 0.2 to 10 $\mu$m, is more preferably from 0.3 to 7.0 $\mu$m, and is most preferably from 0.4 to 5.0 $\mu$m.

In the present invention, employed as silver halide photographic emulsions may be optional emulsions such as polydispersed emulsions having a wide grain size distribution and monodispersed emulsions having a narrow grain size distribution. However, the monodispersed emulsions are preferably employed.

In the present invention, it is possible that in said silver halide photographic emulsions, optionally employed as silver halides may be silver iodobromide, silver iodochlorobromide, or silver iodochloride. However, silver iodobromide and silver iodochlorobromide are particularly preferred.

In the present invention, the average silver iodide content ratio of silver halide grains contained in the silver halide photographic emulsion is preferably from 1 to 40 mole percent, and is more preferably from 2 to 20 mole percent.

Preferably employed as silver halide grains incorporated into the silver halide photographic emulsion, which is preferably employed in the present invention, may be core/shell type grains. Said core/shell type grains, as described herein, refer to those comprised of a core, and a shell covering said core. Said shell is comprised of one or more layers. The silver iodide content ratio of said core and said shell is preferably different from each other.

It is possible to prepare the silver halide emulsion preferably employed in the present invention, employing various methods known in the art.

Namely, it is possible to employ a single-jet method, a double-jet method, a triple-jet method, or a fine silver halide grain supplying method, and combinations thereof. Further, it is possible to employ a method in combination in which the pH as well as the pAg in a liquid phase, in which silver halide is formed, is controlled while matching the growth rate of silver halide grains.

It is also possible to employ a seed emulsion to produce silver halide photographic emulsions. When said seed emulsion is employed, silver halide grains of said seed emulsion may have regular crystal structures such as a cube, octahedron and tetradecahedron, or irregular crystal forms such as a sphere or a tabular form. Of these grains, grains having an optional ratio of the (100) plane to the (111) plane may be employed. Further, grains having complexes of these crystal forms may also be employed, and grains having various crystal forms may be mixed. In the present invention, when said tabular silver halide grains are employed, silver halide grains in the employed seed emulsion are preferably those having a twin plane, and twinned silver halide grains having two parallel twin planes facing each other are particularly preferred.

In the present invention, if a seed emulsion is employed or not employed, it is possible to apply the methods known in the art to determine conditions for silver halide nucleation and ripening.

During the production of silver halide photographic emulsions, it is possible to employ silver halide solvents known in the art. Examples of said silver halide solvents include (a) organic thioethers described in U.S. Pat. Nos. 3,271,157, 3,531,289, and 3,574,628; Japanese Patent Publication Open to Public Inspection Nos. 54-1019, and 54-158917; and Japanese Patent Publication No. 58-30571; (b) thiourea derivatives described in Japanese Patent Publication Open to Public Inspection Nos. 53-82408, 55-29829, 57-77736 and others; (c) silver halide solvents having a thiocarbonyl group interposed between an oxygen or a sulfur atom and a nitrogen atom, as described in Japanese Patent Publication Open to Public Inspection No. 53-144319; (d) imidazoles described in Japanese Patent Publication Open to Public Inspection No. 54-100717; (e) sulfites; (f) thiocyanates; (g) ammonia; (h) ethylenediamines substituted by a hydroxyalkyl group, described in Japanese Patent Publication Open to Public Inspection No. 57-196228; (i) substituted mercaptotetrazoles described in Japanese Patent Publication Open to Public Inspection No. 57-202531; (j) water-soluble bromides; and (k) benzimidazole derivatives described in Japanese Patent Publication Open to Public Inspection No. 58-54333.

It is possible to apply any of an acidic emulsion method, a neutral emulsion method, and an ammonia emulsion method to the production of silver halide photographic emulsions.

In the production of silver halide photographic emulsions, halide ions and silver ions may be simultaneously mixed, or any one of them may be mixed with any others. Further, taking into account the critical growth rate of silver halide crystals, it is possible to add halide ions and silver ions successively, or simultaneously, while controlling the pAg and pH in the reaction vessel. The halide composition of silver halide grains may be varied utilizing a conversion method at any of the stages during the formation of silver halide.

In the production of silver halide photographic emulsions, during the nucleation process and/or the nucleus growth process of silver halide grains, employing at least one selected from a cadmium salt, a zinc salt, a lead salt, a thallium salt, an iridium salt (including its complex salts), a rhodium salt (including its complex salts), an iron salt or other VIII group metal salts (including their complex salts), metal ions may be added so that said metal ions may be incorporated into the interior and the surface of silver halide grains.

In the present invention, it is possible to employ twinned silver halide crystals having two parallel twin planes facing each other, but in this case, the silver halide grain is preferably tabular. The twinned crystals, as described above, are silver halide crystals having at least one twin plane in one grain. The classification of twin crystal structures is described in detail in Klein and Moiser, Photographisches Korrespondenz, Volume 99, page 99 and Volume 100, page 57.

When tabular silver halide grains are employed in the present invention, at least 50 percent of the total projection area of silver halide grains incorporated into the silver halide emulsion subjected to reduction sensitization, which is preferably employed in the present invention, is preferably comprised of tabular silver halide grains, at least 60 percent of the same is more preferably comprised of tabular silver halide grains, and at least 80 percent is still more preferably comprised of tabular silver halide grains.

When tabular silver halide grains are employed in the present invention, the ratio of tabular silver halide grains having two twin planes parallel to the major plane is preferably at least 60 percent in terms of the number of silver halide grains, is more preferably at least 70 percent, and is still more preferably at least 80 percent.

During the production of silver halide emulsions, it is possible to employ materials capable of forming a protective colloid as the dispersion medium, and gelatin is preferably employed.

In the present invention, when gelatin is employed as the dispersing medium, it is possible to employ alkali processed gelatin, acid processed gelatin, or deionized gelatin. Methods for producing such gelatin is detailed in Arthur Veis, "The Macromolecular Chemistry of Gelatin", Academic Press, 1964, and others.

Further, listed as materials capable of functioning as forming protective colloid, other than gelatin, may be, for example, gelatin derivatives, graft polymers of gelatin with other polymers, proteins such as albumin, and casein; cellulose derivatives such as hydroxyethyl cellulose, carboxymethyl cellulose, and cellulose sulfuric acid ester; sugar derivatives such as sodium alginate; and starch derivatives; synthetic or semi-synthetic hydrophilic homopolymers and copolymers such as polyvinyl alcohol, polyvinyl alcohol partial acetal, poly-n-vinylpyrrolidone, polyacrylic acid, polyacrylamide, polymethacrylic acid, polyvinyl imidazole or polyvinyl pyrazole.

Silver halide grains in silver halide photographic emulsions preferably possess dislocation lines in their interior. Positions, in which said dislocation lines are located, are not particularly limited. However, said dislocation lines are preferably located near the exterior surface, edges, or tops of silver halide grains. The ratio of positions, into which said dislocation lines are introduced, is preferably at least 50 percent with respect to the total silver amount of silver halide grains, and is more preferably from 60 to 80 percent. The ratio (by number) of silver halide grains having at least 5 dislocation lines per grain is preferably at least 30 percent, is more preferably at least 50 percent, and is still more preferably at least 80 percent. Further, in each case, the number of dislocation lines per grain is preferably at least 10, is more preferably at least 20, and is still more preferably at least 30.

During production of silver halide photographic emulsions, it is possible to employ oxidizing agents known in the photographic art. Listed as oxidizing agents are, for example, hydrogen peroxide (as an aqueous solution) and addition products thereof, such as $H_2O_2$, $NaBO_2$, $H_2O_2$—$3H_2O$, $2Na_2CO_3$—$3H_2O_2$, $Na_4P_2O_7$—$H_2O_2$, and $2Na_2SO_4$—$H_2O_2$—$2H_2O$, and peroxyacid salts such as $K_2S_2O_3$, $K_2C_2O_3$, $K_4P_2O_3$, $K_2[Ti(O)_2C_2O_4]$—$3H_2O$, peracetic acid, ozone, and thiosulfonic acid compounds.

During production of silver halide emulsions, reduction sensitization may be carried out in combination of said oxidizing agents.

During production of silver halide photographic emulsions, it is possible to carry out desalting during formation of silver halide grains, or after forming silver halide grains, for the purpose of preventing physical ripening or removing unnecessary salts. Desalting may be carried out, for example, employing the method described in Research Disclosure (hereinafter referred to as RD) Item 17643 Sect. II.

In order to remove unnecessary water-soluble salts from flocculated compositions or emulsions after physical ripening, a noodle washing method may be employed in which gelatin is gelled. Alternatively, it is possible to employ a flocculation method, employing inorganic salts, anionic surface active agents, anionic polymers (for example, polystyrene sulfonic acid), or gelatin derivatives (for example, acylated gelatin and carbamoyled gelatin).

Employed as other desalting methods may be desalting utilizing membrane separation described in "Kagaku Kogaku Binran (Handbook of Chemical Engineering)", 5th Edition, pages 924 to 954, edited by Kagakukogaku Kyokai and published by Maruzen, and others.

Methods described RD Volume 102 Item 10208 and Volume 131 Item 13122; Japanese Patent Publication Nos. 59-43727 and 62-27008; Japanese Patent Publication Open to Public Inspection Nos. 62-113137, 57-209823, 59-43727, 62-113137, 61-219948, 62-23035, 63-40137, 63-40039, 3-140946, 2-172816, 2-172817, and 4-22942, and others may be applicable to said membrane separation.

In the production of silver halide photographic emulsions, it is possible to select suitable conditions other than those described above while referring to Japanese Patent Publication Open to Public Inspection Nos. 61-6643, 61-14630, 61-112142, 62-157024, 62-18556, 63-92942, 63-151618, 63-163451, 63-220238, and 63-311244; RD Volume 365 Item 36544, Volume 367, Item 36736, and volume 391 Item 39121; and others.

Additives, which are employed to constitute color photographic materials employing silver halide emulsions, are described in RD Items 17643, 18716 and 308119. Tables 1 and 2 show reference sites of concerned compounds.

TABLE 1

| Item | RD308119 Page Sec. | RD17643 | RD18716 |
|---|---|---|---|
| Chemical sensitizer | 996 III-A | 23 | 648 |
| Spectral sensitizer | 996 IV-A-A, B, C, D, H, I, J | 23 to 24 | 648 to 649 |
| Supersensitizer | 996 IV-A- E, J | 23 to 24 | 648 to 649 |
| Antifoggant | 998 VI | 24 to 25 | 649 |
| Stabilizer | 998 VI | 24 to 25 | 649 |

TABLE 2

| Item | RD308119 Page Sec. | RD17643 | RD18716 |
|---|---|---|---|
| Color contamination minimizing agent | 1002 VII-I | 25 | 650 |
| Dye image stabilizer | 1001 VII-J | 25 | |
| Brightening agent | 998 V | 24 | |
| UV absorber | 1003 VIII-I, XIIIC | 25 to 26 | |
| Light absorber | 1003 VIII | 25 to 26 | |
| Light scattering agent | 1003 VIII | | |
| Filter dye | 1003 VIII | 25 to 26 | |
| Binder | 1003 IX | 26 | 651 |
| Antistatic agent | 1006 XIII | 27 | 650 |
| Hardener | 1004 X | 26 | 651 |
| Plasticizer | 1006 XII | 27 | 650 |
| Lubricant | 1006 XII | 27 | 650 |
| Surfactant & Coating aid | 1005 XI | 26 to 27 | 650 |
| Matting agent | 1007 XVI | | |
| Developing agent | 1011 XX-B | | |

When light-sensitive color photographic materials are constituted employing silver halide emulsions, it is possible to employ various types of couplers. Specific examples of said couplers are described in the aforementioned RD. Table 3 shows reference sites of concerned couplers.

TABLE 3

| Coupler | RD308119 Page Sec. | RD17643 |
|---|---|---|
| Yellow coupler | 1001 VII-D | VIIC to G |
| Magenta coupler | 1001 VII-D | VIIC to G |
| Cyan coupler | 1001 VII-D | VIIC to G |
| Colored coupler | 1002 VII-G | VIIG |
| DIR coupler | 1001 VII-F | VIIF |
| BAR coupler | 1002 VII-F | |
| Other photographically useful agents releasing coupler | 1001 VII-F | |
| Alkali soluble coupler | 1001 VII-E | |

Additives, which are employed to constitute light-sensitive color materials employing silver halide emulsions may be added employing the dispersion method described in RD Item 308119 XIV. When light-sensitive color materials are constituted employing silver halide emulsions, it is possible to use supports described in RD Item 17643 page 28, RD Item 18716 pages 647 to 648, and RD Item 308119 XIX.

Light-sensitive color photographic materials, employing silver halide emulsions, may be provided with auxiliary layers such as filter layers or interlayers described in RD Item 308119 VII-K.

Light-sensitive color photographic materials, employing silver halide emulsions, may be constituted utilizing various layer configurations such as a conventional layer order, a reversed layer order or a unit constitution as described in RD Item 308119 VII-K.

Silver halide emulsions may be applied to various types of color photographic materials, represented by color negative film for general use or cinema use, color reversal film for slide or television applications, color paper, color positive film, and color reversal paper and various types of black-and-white light-sensitive materials such as monochromatic negative film, microfilm, and X-ray film.

Light-sensitive color photographic materials employing silver halide emulsions may be subjected to photographic processing employing conventional methods described in RD Item 17643 pages 28 to 29, RD Item 18716 page 615, and RD Item 308119 XIX.

EXAMPLES

The present invention will now be described with reference to specific examples. However, the embodiments of the present invention are not limited to these examples.

Example 1

<Preparation of Color Light-Sensitive Material>

Multi-Layered Light-Sensitive Color Material 101 was prepared in such a manner that each layer comprised of the composition described below was successively applied onto a subbed triacetyl cellulose film support from the support surface. The added amount of each compound was represented in terms of g/m$^2$, unless otherwise specified. The amount of silver halide or colloidal silver was converted to the silver amount and the amount of sensitizing dyes (SD) was represented in mole/mole of Ag.

First Layer (Antihalation Layer)

| | |
|---|---|
| Black colloidal silver | 0.16 |
| UV-1 | 0.30 |
| CM-1 | 0.12 |
| CC-1 | 0.03 |
| OIL-1 | 0.24 |
| Gelatin | 1.33 |

Second Layer (Interlayer)

| | |
|---|---|
| Iodobromide Emulsion J | 0.10 |
| AS-1 | 0.12 |
| OIL-1 | 0.15 |
| Gelatin | 0.67 |

Third Layer (Low Speed Red Sensitive Layer)

| | |
|---|---|
| Silver Iodobromide Emulsion c | 0.053 |
| Silver Iodobromide Emulsion d | 0.11 |
| Silver Iodobromide Emulsion e | 0.11 |
| SD-1 | $2.2 \times 10^{-5}$ |
| SD-2 | $5.9 \times 10^{-5}$ |
| SD-3 | $1.2 \times 10^{-4}$ |
| SD-4 | $1.6 \times 10^{-4}$ |
| SD-5 | $1.6 \times 10^{-4}$ |
| C-1 | 0.19 |
| CC-1 | 0.003 |
| OIL-2 | 0.096 |
| AS-2 | 0.001 |
| Gelatin | 0.44 |

Fourth Layer (Medium Speed Red Sensitive Layer)

| | |
|---|---|
| Silver Iodobromide Emulsion b | 0.28 |
| Silver Iodobromide Emulsion c | 0.34 |
| Silver Iodobromide Emulsion d | 0.50 |
| SD-1 | $1.8 \times 10^{-5}$ |
| SD-4 | $2.6 \times 10^{-4}$ |
| SD-5 | $2.8 \times 10^{-4}$ |
| C-1 | 0.74 |
| CC-1 | 0.081 |
| DI-1 | 0.020 |
| DI-4 | 0.008 |
| OIL-2 | 0.42 |
| AS-2 | 0.003 |
| Gelatin | 1.95 |

Fifth Layer (High Speed Red Sensitive Layer)

| | |
|---|---|
| Silver Iodobromide Emulsion a | 1.45 |
| Silver Iodobromide Emulsion e | 0.076 |
| SD-1 | $2.3 \times 10^{-5}$ |
| SD-2 | $1.1 \times 10^{-4}$ |
| SD-3 | $1.5 \times 10^{-5}$ |
| SD-4 | $2.1 \times 10^{-4}$ |
| C-2 | 0.087 |
| C-3 | 0.12 |
| CC-1 | 0.036 |
| DI-1 | 0.021 |
| DI-3 | 0.005 |
| BAR-1 | 0.022 |
| OIL-2 | 0.15 |
| AS-2 | 0.004 |
| Gelatin | 1.40 |

Sixth Layer (Interlayer)

| | |
|---|---|
| F-1 | 0.03 |
| AS-1 | 0.18 |
| OIL-1 | 0.22 |
| Gelatin | 1.00 |

Seventh Layer (Low Speed Green Sensitive Layer)

| | |
|---|---|
| Silver Iodobromide Emulsion c | 0.22 |
| Silver Iodobromide Emulsion e | 0.22 |
| SD-6 | $4.7 \times 10^{-5}$ |
| SD-7 | $2.6 \times 10^{-4}$ |
| SD-8 | $1.9 \times 10^{-4}$ |
| SD-9 | $1.1 \times 10^{-4}$ |
| SD-10 | $2.4 \times 10^{-5}$ |
| M-1 | 0.35 |
| CM-1 | 0.044 |
| DI-2 | 0.010 |

-continued

| | |
|---|---|
| OIL-1 | 0.41 |
| AS-2 | 0.001 |
| AS-3 | 0.11 |
| Gelatin | 1.29 |

Eighth Layer (Medium Speed Green Sensitive Layer)

| | |
|---|---|
| Silver Iodobromide Emulsion b | 0.90 |
| Silver Iodobromide Emulsion e | 0.048 |
| SD-6 | $3.8 \times 10^{-5}$ |
| SD-7 | $2.6 \times 10^{-5}$ |
| SD-8 | $3.4 \times 10^{-4}$ |
| SD-9 | $1.6 \times 10^{-4}$ |
| SD-10 | $4.4 \times 10^{-5}$ |
| M-1 | 0.15 |
| CM-1 | 0.062 |
| CM-2 | 0.030 |
| DI-2 | 0.032 |
| OIL-1 | 0.28 |
| AS-2 | 0.005 |
| AS-3 | 0.045 |
| Gelatin | 1.00 |

Ninth Layer (High Speed Green Sensitive Layer)

| | |
|---|---|
| Silver Iodobromide Emulsion a | 1.39 |
| Silver Iodobromide Emulsion e | 0.073 |
| SD-6 | $4.1 \times 10^{-5}$ |
| SD-7 | $2.6 \times 10^{-5}$ |
| SD-8 | $3.7 \times 10^{-4}$ |
| SD-10 | $4.9 \times 10^{-5}$ |
| M-1 | 0.071 |
| M-2 | 0.073 |
| CM-2 | 0.013 |
| DI-2 | 0.004 |
| DI-3 | 0.003 |
| OIL-1 | 0.27 |
| AS-2 | 0.008 |
| AS-3 | 0.043 |
| Gelatin | 1.35 |

Tenth Layer (Yellow Filter Layer)

| | |
|---|---|
| Yellow colloidal silver | 0.053 |
| AS-1 | 0.15 |
| OIL-1 | 0.13 |
| X-1 | 0.06 |
| Gelatin | 0.83 |

Eleventh Layer (Low Speed Blue Sensitive Layer)

| | |
|---|---|
| Silver Iodobromide Emulsion g | 0.22 |
| Silver Iodobromide Emulsion h | 0.099 |
| Silver Iodobromide Emulsion i | 0.17 |
| SD-11 | $2.4 \times 10^{-4}$ |
| SD-12 | $5.7 \times 10^{-4}$ |
| SD-13 | $1.3 \times 10^{-4}$ |
| Y-1 | 1.02 |
| BAR-1 | 0.022 |
| OIL-1 | 0.42 |
| AS-2 | 0.003 |
| X-1 | 0.11 |
| X-2 | 0.18 |
| Gelatin | 1.95 |

Twelfth Layer (High Speed Blue Sensitive Layer)

| | |
|---|---|
| Silver Iodobromide Emulsion f | 1.52 |
| SD-11 | $8.3 \times 10^{-5}$ |
| SD-12 | $2.3 \times 10^{-4}$ |
| Y-1 | 0.22 |
| DI-5 | 0.11 |
| OIL-1 | 0.13 |
| AS-2 | 0.003 |
| X-1 | 0.15 |
| X-2 | 0.20 |
| Gelatin | 1.20 |

Thirteenth Layer (First Protective Layer)

| | |
|---|---|
| Silver Iodobromide Emulsion j | 0.30 |
| UV-1 | 0.11 |
| UV-2 | 0.055 |
| Liquid paraffin | 0.28 |
| X-1 | 0.079 |
| Gelatin | 1.00 |

Fourteenth Layer (Second Protective Layer)

| | |
|---|---|
| PM-1 | 0.13 |
| PM-2 | 0.018 |
| WAX-1 | 0.021 |
| Gelatin | 0.55 |

Features of the silver iodobromide emulsions employed as above are shown below (the average grain size refers to an edge length of a cube having the same volume as that of the grain).

| Emulsion No. | Av. Grain Size (μm) | Av. AgI Content (mole %) | Diameter/ Thickness Ratio |
|---|---|---|---|
| Silver Iodobromide Emulsion a | 0.85 | 4.2 | 7.0 |
| b | 0.70 | 4.2 | 6.0 |
| c | 0.50 | 4.2 | 5.0 |
| d | 0.38 | 8.0 | octahedron twin crystal |
| e | 0.27 | 2.0 | Tetradecahedron regular crystal |
| f | 1.00 | 8.0 | 4.5 |
| g | 0.74 | 3.5 | 6.2 |
| h | 0.44 | 4.2 | 6.1 |
| i | 0.30 | 1.9 | 5.5 |
| j | 0.03 | 2.0 | 1.0 |

The aforementioned sensitizing dyes were added to each of said emulsions and the resulting emulsion was ripened. Thereafter, triphenylphosphine selenide, sodium thiosulfate, chloroauric acid, and potassium thiocyanate were added. Subsequently, the resulting emulsion underwent chemical sensitization employing a conventional method so that the relationship between the fog and the sensitivity was optimized, and then employed.

In addition to said components, were added Coating Aids SU-1, SU-2 and Dispersing Aid SU-4; Viscosity-Adjusting Agent V-1; Stabilizers ST-1 and ST-2; two types of polyvinylpyrrolidone (AF-1 and AF-2) of a weight average molecular weight of 100,000; Restrainers AF-3, AF-4 and AF-5; Hardeners H-1 and H-2; and Antiseptic Ase-1.

Structures of compounds employed in said samples are shown below.

M-1

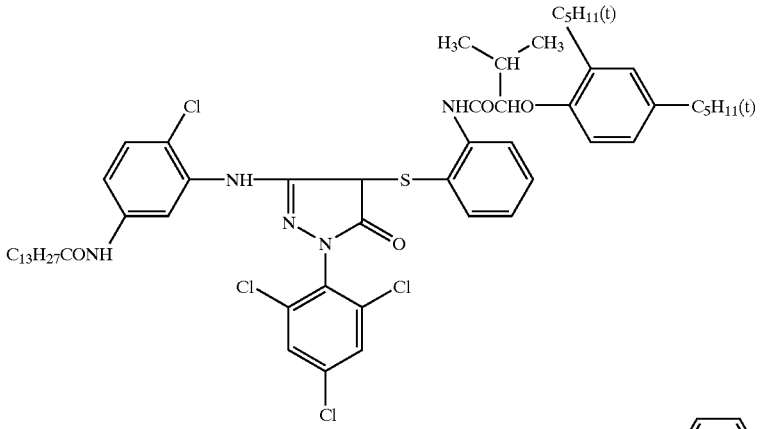

M-2

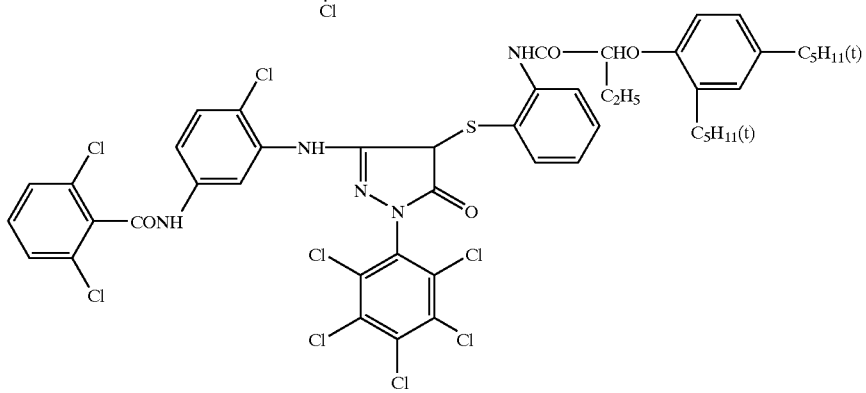

-continued
Y-1
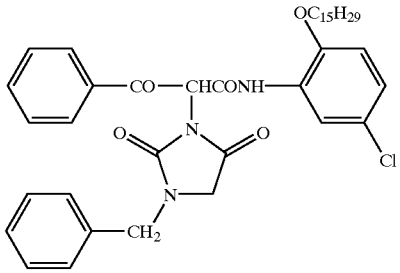
C-1
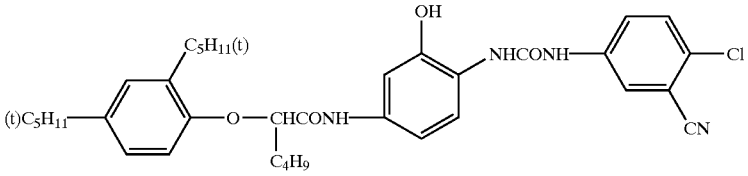
C-2
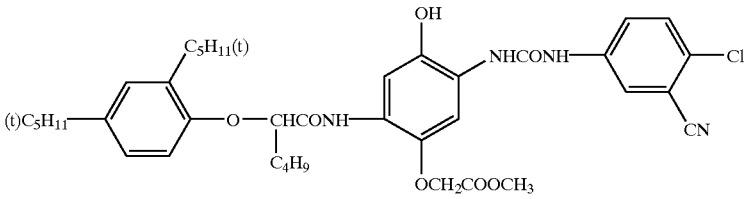
CC-1
C-3
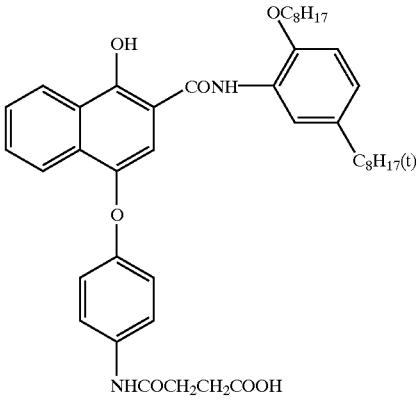
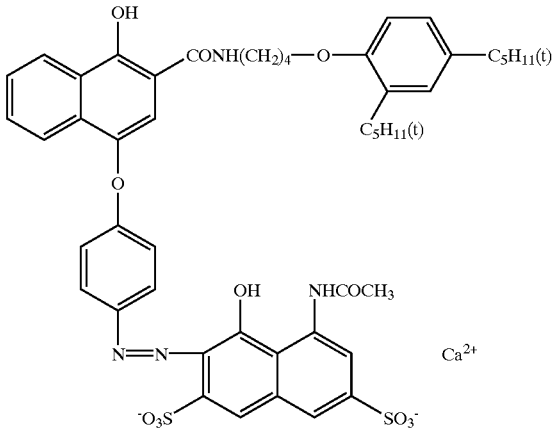
CM-1
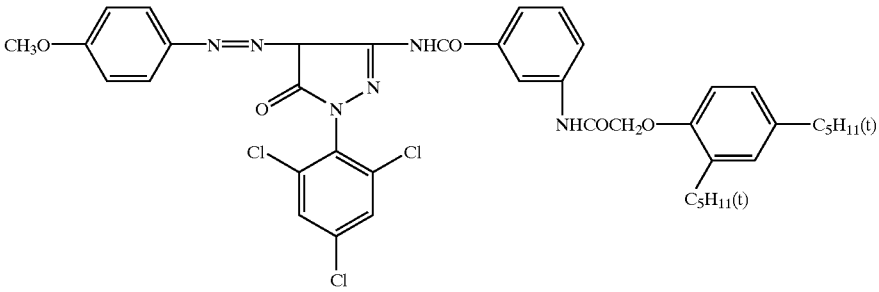

-continued
CM-2
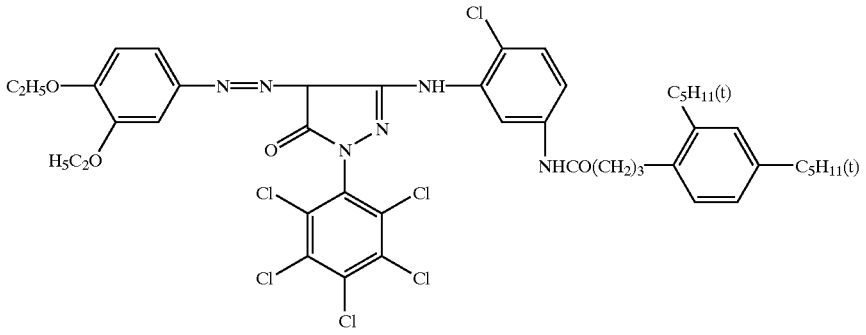
BAR-1
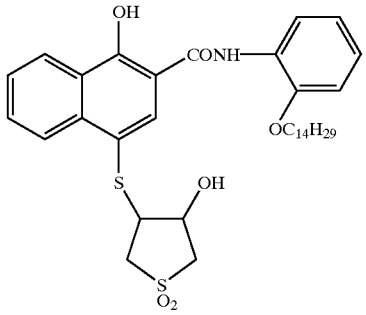
DI-1
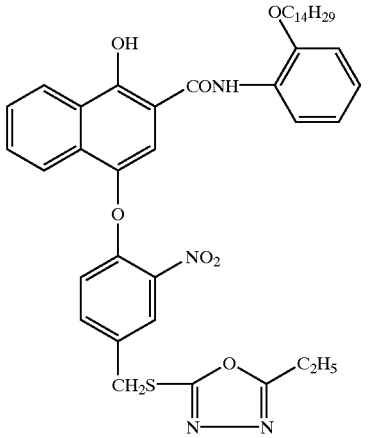
DI-2
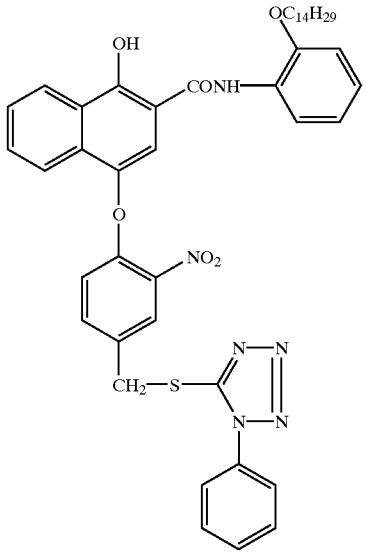
DI-3
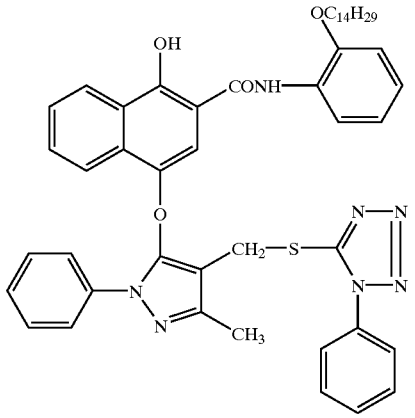

-continued
DI-4
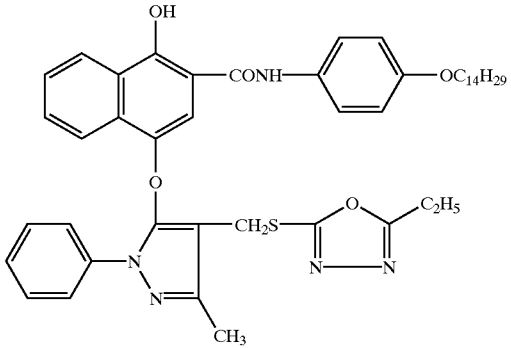
DI-5
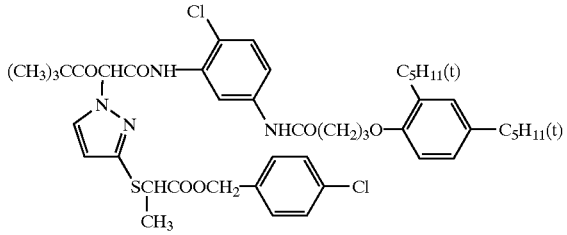
AS-1
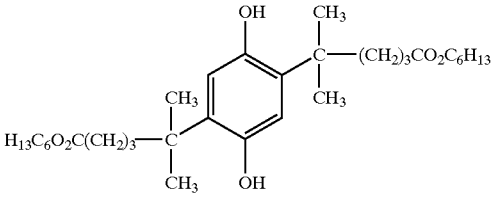
AS-2
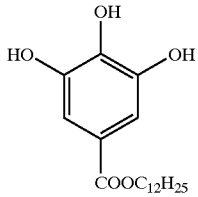
AS-3
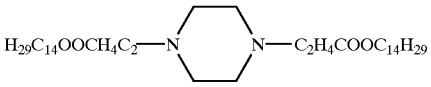
OIL-1
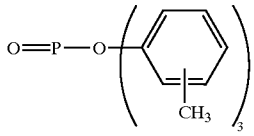
UV-1
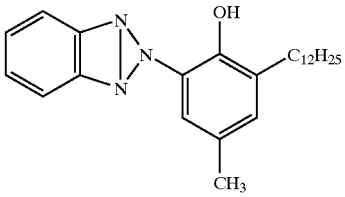
OIL-2
$H_9C_4OOC(CH_2)_8COOC_4H_9$
UV-2
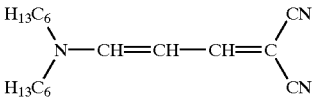
V-1
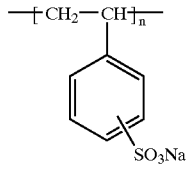
n: degree of polymerization
Ase-1 (Mixture of three components described below)
(Component A)
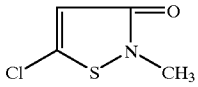
(Component B)
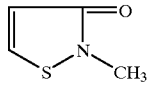
-continued
(Component C)
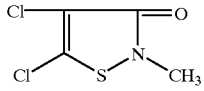
Component A: Component B Component C=50:46:4 (in mole ratio)
H-1
$CH_2{=}CHSO_2CH_2CONHCH_2CH_2NHCOCH_2SO_2CH{=}CH_2$ H-2
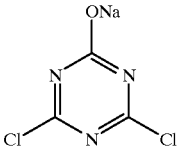
SD-1
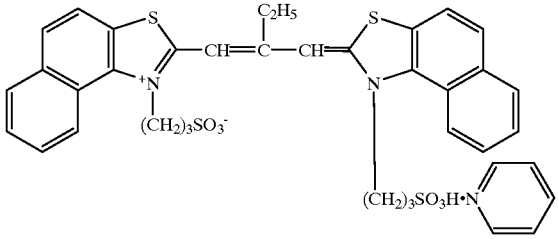
SD-2
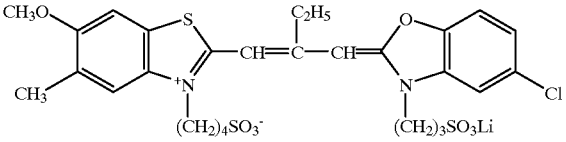
SD-3
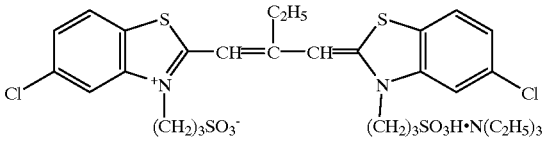
SD-4
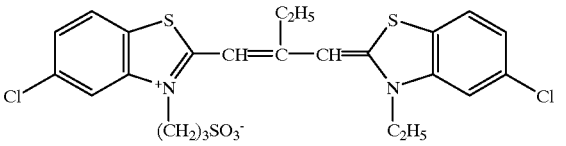
SD-5
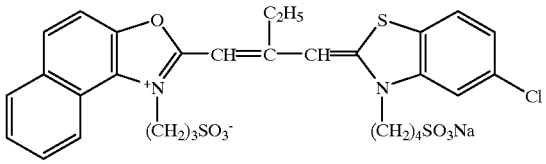
SD-6
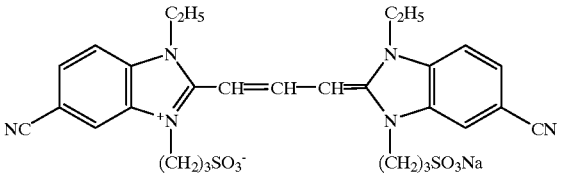
SD-7
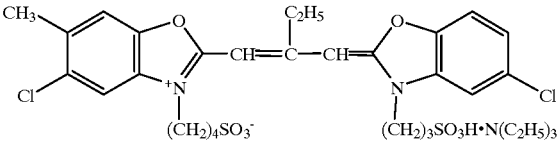
SD-8
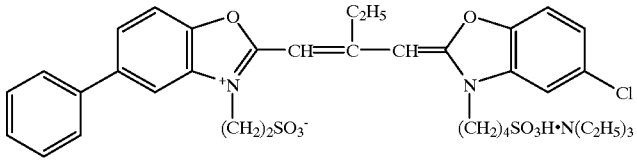
SD-9
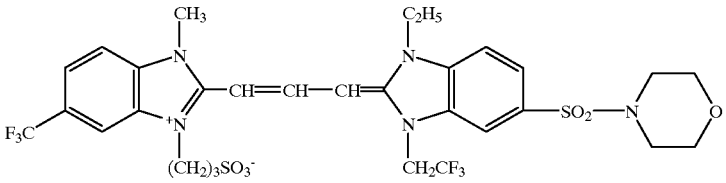
SD-10
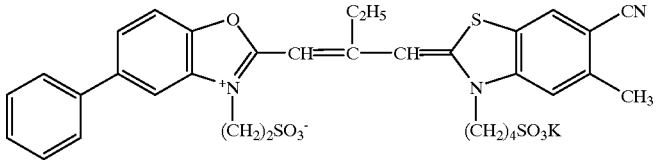
SD-11
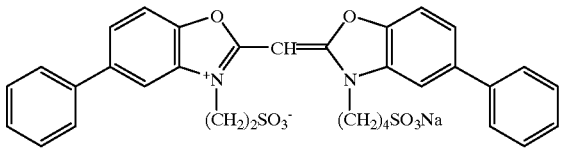
SD-12
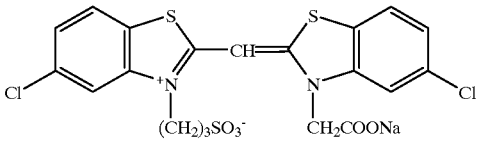

-continued
SD-13
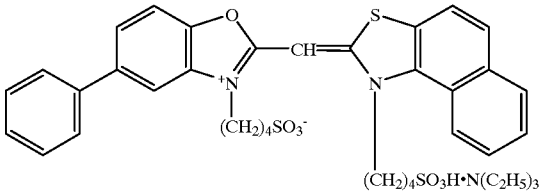
F-1
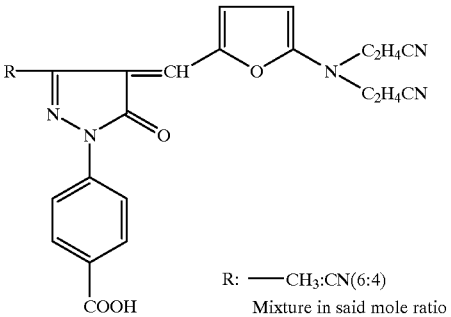
R: $CH_3$:CN(6:4)
Mixture in said mole ratio
ST-1
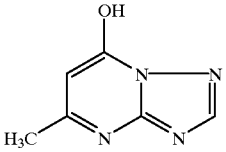
ST-2
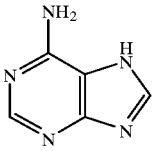
AF-1,2
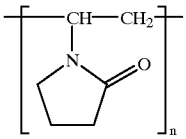
AF-1 Mw ≒ 10,000
AF-2 Mw ≒ 100,000
n: degree of polymerization
AF-3
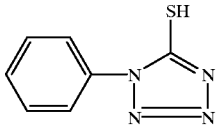
AF-4
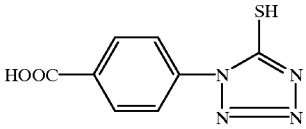
AF-5
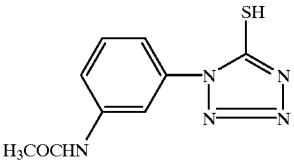
X-1
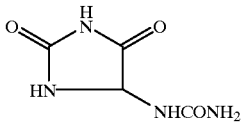
X-2
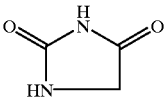
SU-1
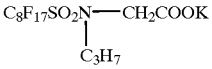
SU-2
$C_8F_{17}SO_2NH(CH_2)_3N^+(CH_3)_3Br^-$
SU-3
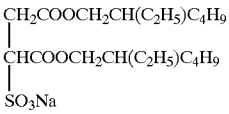
SU-4
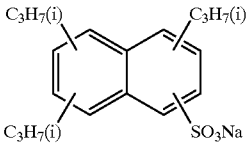
WAX-1
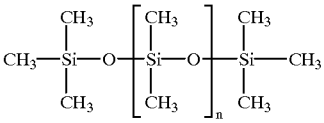
Mw = 3,000

-continued

PM-1

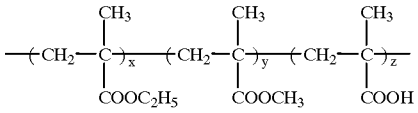

x:y:z = 3:3:4

PM-2

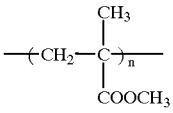

n: degree of polymerization

Samples 102 through 152 were prepared in the same manner as Sample 101, except that each of compounds described in Table 4 was added in an amount of $2.7\times10^{-5}$ mole per mole of silver to each of the third layer, the fourth layer, the fifth layer, the seventh layer, the eighth layer, the ninth layer, the eleventh layer, and the twelfth layer of said Sample 101.

<<Evaluation of Photographic Performance>>

<Evaluation of Fog and Sensitivity>

Each sample was subjected to wedge exposure, utilizing white light and subsequently subjected to the photographic processing described below. Fog and sensitivity were then evaluated. Incidentally, said sensitivity was obtained as follows. The inverse of the exposure amount, which resulted in minimum density plus 0.3, was obtained for yellow density by sensitometry, and the resulting sensitivity was represented by a relative sensitivity (blue sensitivity) using the sensitivity of Sample 101 as 100. Said fog was represented by the value which was obtained by subtracting the density of each sample which had been subjected to photographic processing without the color development step from the density of the same sample, which had been subjected to the photographic processing.

<Photographic Processing>

| Processing step | Time | Temperature | Replenishing Rate* |
|---|---|---|---|
| Color Development | 3 min. 15 sec. | 38 ± 0.3° C. | 780 ml |
| Bleach | 45 sec. | 38 ± 2.0° C. | 150 ml |
| Fix | 1 min. 30 sec. | 38 ± 2.0° C. | 830 ml |
| Stabilization | 60 sec. | 38 ± 5.0° C. | 830 ml |
| Drying | 1 min. | 55 ± 5.0° C. | — |

*Amounts per $m^2$ of photographic material

A color developer, bleach, fixer and stabilizer, and replenishers thereof were prepared according to the following formulas.

| Color Developer | |
|---|---|
| Water | 800 ml |
| Potassium carbonate | 30 g |
| Sodium hydrogencarbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-(β-hydroxyethyl)-aniline sulfate | 4.5 g |
| Diethylenetriaminepentaacetic acid | 3.0 g |
| Potassium hydroxide | 1.2 g |
| Water to make | 1 liter. |

The pH was adjusted to 10.06 by adding potassium hydroxide or 20 percent sulfuric acid.

| Color Developer Replenisher | |
|---|---|
| Water | 800 ml |
| Potassium carbonate | 35 g |
| Sodium hydrogencarbonate | 3 g |
| Potassium sulfite | 5 g |
| Sodium bromide | 0.4 g |
| Hydroxylamine sulfate | 3.1 g |
| 4-Amino-3-methyl-N-(β-hydroxyethyl)-aniline sulfate | 6.3 g |
| Potassium hydroxide | 2.0 g |
| Diethylenetriaminepentaacetic acid | 3.0 g |
| Water to make | 1 liter. |

The pH was adjusted to 10.18 by adding potassium hydroxide or 20 percent sulfuric acid.

| Bleach | |
|---|---|
| Water | 700 ml |
| Ammonium iron (III) 1,3-diamino-propanetetraacetic acid | 125 g |
| Ethylenediaminetetraacetic acid | 2 g |
| Sodium nitrate | 40 g |
| Ammonium bromide | 150 g |
| Glacial acetic acid | 40 g |

The pH was adjusted to 4.4 by adding ammonia water or glacial acetic acid, and subsequently the total volume was adjusted to 1 liter by adding water.

| Bleach Replenisher | |
|---|---|
| Water | 700 ml |
| Ammonium iron (III) 1,3-diamino-propanetetraacetic acid | 175 g |
| Ethylenediaminetetraacetic acid | 2 g |
| Sodium nitrate | 50 g |
| Ammonium bromide | 200 g |
| Glacial acetic acid | 56 g |

The pH was adjusted to 4.4 by adding ammonia water or glacial acetic acid, and subsequently the total volume was adjusted to 1 liter by adding water.

| Fixer | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |

The pH was adjusted to 6.2 by adding ammonia water or glacial acetic acid, and subsequently the total volume was adjusted to 1 liter by adding water.

| Fixer Replenisher | |
|---|---|
| Water | 800 ml |
| Ammonium thiocyanate | 150 g |
| Ammonium thiosulfate | 180 g |
| Sodium sulfite | 20 g |
| Ethylenediaminetetraacetic acid | 2 g |

The pH was adjusted to 6.5 by adding ammonia water or glacial acetic acid, and subsequently the total volume was adjusted to 1 liter by adding water.

| Stabilizer and Stabilizer Replenisher | |
|---|---|
| Water | 900 ml |
| p-Octylphenylpolyoxyethylene ether (n = 10) | 2.0 g |
| Dimethylolurea | 0.5 g |
| Hexamethylenetetramine | 0.2 g |
| 1,2-benzoisothiazoline-3-one | 0.1 g |
| Siloxane (L-77, manufactured by UCC) | 0.1 g |
| Ammonia water | 0.5 ml |
| Water to make | 1 liter |

The pH was adjusted to 8.5 by adding ammonia water or 50 percent sulfuric acid. Table 4 shows the results.

<Evaluation of Pressure Resistance>

Under the adjusted condition of 40 percent relative humidity, each sample was bent along a diameter 10 mm stainless steel pipe while one end of said sample was fixed so as to arrange the emulsion surface inward. Said bending was carried out 10 seconds prior to exposure. Each sample treated as above was subjected to wedge exposure employing white light, and subsequently subjected to said photographic processing. Obtained yellow density fog (the blue sensitive layer) was evaluated in both bent areas and non-bent areas.

Table 4 shows the results.

Comparative Compound 1

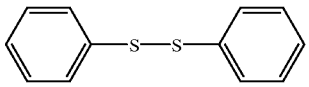

Comparative Compound 2

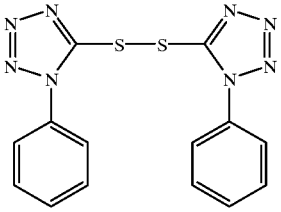

(3) Comparative Compound 3

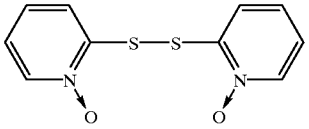

TABLE 4

| Sample No. | Type of Added Compound | Blue Sensitivity | Fog | Pressure Fog | Remarks |
|---|---|---|---|---|---|
| 101 | — | 100 | 0.28 | 0.56 | Comp. |
| 102 | Comparative Compound 1 | 95 | 0.27 | 0.48 | Comp. |
| 103 | Comparative Compound 2 | 91 | 0.15 | 0.43 | Comp. |
| 104 | Comparative Compound 3 | 96 | 0.09 | 0.20 | Comp. |
| 106 | 2-1 | 101 | 0.06 | 0.14 | Inv. |
| 107 | 2-4 | 100 | 0.03 | 0.11 | Inv. |
| 108 | 2-21 | 100 | 0.05 | 0.13 | Inv. |
| 109 | 3-1 | 102 | 0.04 | 0.12 | Inv. |
| 110 | 3-2 | 100 | 0.05 | 0.11 | Inv. |
| 111 | 3-8 | 99 | 0.06 | 0.12 | Inv. |
| 112 | 4-1 | 100 | 0.07 | 0.14 | Inv. |
| 113 | 4-5 | 102 | 0.04 | 0.10 | Inv. |
| 114 | 5-1 | 100 | 0.03 | 0.10 | Inv. |
| 115 | 5-3 | 102 | 0.04 | 0.11 | Inv. |
| 116 | 6-2 | 99 | 0.01 | 0.09 | Inv. |
| 117 | 6-4 | 100 | 0.02 | 0.12 | Inv. |
| 118 | 6-11 | 102 | 0.02 | 0.11 | Inv. |
| 119 | 6-15 | 101 | 0.03 | 0.12 | Inv. |
| 120 | 7-1 | 102 | 0.01 | 0.10 | Inv. |
| 121 | 7-8 | 98 | 0.02 | 0.11 | Inv. |
| 122 | 8-5 | 100 | 0.03 | 0.09 | Inv. |
| 123 | 8-8 | 100 | 0.02 | 0.12 | Inv. |
| 124 | 9-1 | 101 | 0.04 | 0.14 | Inv. |
| 125 | 9-2 | 100 | 0.03 | 0.13 | Inv. |
| 126 | 9-14 | 99 | 0.03 | 0.12 | Inv. |
| 127 | 9-18 | 100 | 0.02 | 0.10 | Inv. |
| 128 | 9-21 | 101 | 0.04 | 0.13 | Inv. |
| 129 | 9-27 | 100 | 0.03 | 0.11 | Inv. |
| 130 | 10-3 | 102 | 0.01 | 0.08 | Inv. |
| 131 | 11-2 | 99 | 0.04 | 0.12 | Inv. |
| 132 | 11-3 | 102 | 0.05 | 0.1 | Inv. |
| 133 | 11-6 | 101 | 0.04 | 0.11 | Inv. |
| 134 | 11-12 | 100 | 0.06 | 0.1 | Inv. |
| 135 | 11-17 | 102 | 0.05 | 0.12 | Inv. |
| 136 | 12-1 | 101 | 0.05 | 0.09 | Inv. |
| 137 | 12-5 | 100 | 0.07 | 0.1 | Inv. |
| 138 | 12-8 | 99 | 0.06 | 0.1 | Inv. |
| 139 | 13-6 | 99 | 0.05 | 0.13 | Inv. |
| 140 | 13-9 | 100 | 0.04 | 0.12 | Inv. |
| 141 | 14-1 | 101 | 0.04 | 0.11 | Inv. |
| 142 | 14-2 | 102 | 0.05 | 0.12 | Inv. |
| 143 | 14-8 | 99 | 0.06 | 0.11 | Inv. |
| 144 | 14-15 | 100 | 0.05 | 0.14 | Inv. |
| 145 | 14-17 | 101 | 0.04 | 0.12 | Inv. |
| 146 | 14-23 | 99 | 0.05 | 0.13 | Inv. |
| 147 | 14-29 | 99 | 0.05 | 0.12 | Inv. |
| 148 | 15-1 | 101 | 0.02 | 0.09 | Inv. |
| 149 | 15-2 | 100 | 0.01 | 0.07 | Inv. |
| 150 | 15-7 | 99 | 0.02 | 0.08 | Inv. |
| 151 | 15-8 | 100 | 0.02 | 0.07 | Inv. |
| 152 | 15-11 | 99 | 0.01 | 0.06 | Inv. |

Inv.; Present Invention, Comp.; Comparative Example

As can clearly be seen from Table 4, samples, in which compounds represented by Formulas 1, 6 through 14 of the present invention were employed, resulted in a decrease in the density of pressure fog which was noted in the bent samples, and further, said density decrease exceeded the magnitude which resulted in effects of samples in which listed comparative compounds were employed.

Samples, in which compounds represented by Formulas 1, 6 through 14 of the present invention were employed, exhibited excellent characteristics in which fog decreased, while the decrease in sensitivity was barely noticed, (on the other hand, samples, in which comparative compounds were employed, resulted in a decrease in sensitivity).

Example 2

(Preparation of Seed Emulsion T-1)

Seed Emulsion T-1, having two parallel twin planes facing each other, was prepared employing the method described below.

| | |
|---|---|
| Composition E-1 | |
| Deionized alkali processed gelatin (having an weight average molecular weight of 15,000) | 244.0 g |
| Potassium bromide | 156.6 g |
| 10 percept methanol solution of Surface Active Agent EO-1 | 0.48 ml |
| Water to make | 34.0 liters |
| Composition F-1 | |
| Silver nitrate | 1200 g |
| Water to make | 3716 ml |
| Composition G-1 | |
| Deionized alkali processed gelatin (having an weight average molecular weight of 15,000) | 31.6 g |
| Potassium bromide | 906.0 g |
| Water to make | 4.0 liters |
| Composition H-1 | |
| Ammonia water (28 percent) | 299 ml |
| Composition I-1 | |
| Water to make | 8.0 liters |
| Composition J-1 | |
| Ossein gelatin | 400.0 g |
| Water to make | 4832 ml |
| Composition K-1 | |
| Potassium bromide | 69.2 g |
| Water to make | 386 ml |
| Composition L-1 | |
| 56 percent aqueous acetic acid solution | 1000 ml |

Added to Composition E-1 was Composition I-1 at 30° C. under vigorous stirring, employing a stirring device described in Japanese Patent Publication Open to Public Inspection No. 62-160128. Subsequently, Compositions F-1 and G-1 were added over a period of 2 minutes, employing a double-jet method, whereby silver halide nuclei were generated.

Thereafter, Composition J-1 was added, and the resulting mixture was heated to 68° C. over a period of 41 minutes. Further, Composition H-1 was added, and the resulting mixture underwent ripening for 5 minutes. Thereafter, Composition K-1 was further added, and after one minute, the pH was adjusted to 4.7 by adding Composition L-1, and desalting was immediately carried out.

The resulting seed emulsion was observed by employing an electron microscope. It was noted that the resulting emulsion was a monodispersed seed emulsion having two twin planes parallel to each other, an average grain diameter (being a grain diameter in which the grain projection area was converted to a circle having the same area) of 0.31 pm, and a grain size distribution of 16 percent. (Preparation of Emulsion Em-11)

Em-11 was prepared employing compositions shown below.

| | |
|---|---|
| Composition H-2 | |
| Ossein gelatin | 223.6 g |
| 10 percent methanol solution of Surface Active Agent EO-1 | 3.6 ml |
| Seed Emulsion T-1 | amount equivalent to 0.774 mole |
| Water to make | 5904 ml |
| Composition I-2 | |
| 3.5 moles/liter aqueous silver nitrate solution | 6490 ml |
| Composition J-2 | |
| 3.5 moles/liter aqueous potassium bromide solution | 7500 ml |
| Composition K-2 | |
| Fine grain emulsion comprised of 3.0 percent gelatin and fine silver iodide (having an average grain diameter of 0.05 $\mu$m) | |

Preparation method: added to 5,000 ml of 6.0 percent gelatin solution, comprising 0.06 mole of potassium iodide, were 1,000 ml of an aqueous solution comprising 7.06 moles of silver nitrate and 1,000 ml of an aqueous solution comprising 7.06 moles of potassium iodide at the same rate over a period of 10 minutes. During grain formation, the pH was adjusted to 2.0 by adding nitric acid, while the temperature was adjusted to 40° C. After said addition, the pH was adjusted to 6.0 by adding an aqueous sodium carbonate solution. The final weight was 12.53 kg.

| | |
|---|---|
| Composition L-2 | |
| 1.75 moles/liter aqueous potassium bromide solution | required amount |
| Composition M-2 | |
| 56 percent aqueous glacial acetic acid solution | required amount |
| Composition N-2 | |
| 3.5 moles/liter aqueous potassium bromide solution | 500 ml |

Composition H-2 was added to a reaction vessel and subsequently, Composition I-2, Composition J-2, and Composition K-2 were added under vigorous stirring in accordance with the combinations shown in Table 5, employing a triple-jet method, whereby seed crystals were allowed to grow in preparation of a core/shell type silver halide emulsion.

Herein, the addition rate of Composition I-2, Composition J-2, and Composition K-2 was functionally varied with respect to the addition time, taking into account the critical growth rate, so that neither generation of minute grains, other than growing seed grains, nor degradation of the grain size distribution due to Ostwald ripening among the growing grains, occurred.

EO-1

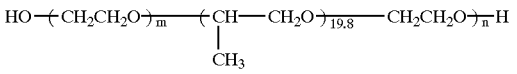

(m + n = 9.77)

TABLE 5

| Added Composition | Added Time (in min.) | Added Silver Amount (in %) | Composition of Halogen Components in Added Composition (in mole %) | Addition Classification |
|---|---|---|---|---|
| | 0.00 | 0.0 | 6.0 | First Addition |
| I-2 | 23.13 | 5.0 | 6.0 | |
| J-2 | 41.45 | 10.0 | 6.0 | |
| K-2 | 70.27 | 20.0 | 6.0 | |
| | 110.56 | 40.0 | 6.0 | |
| | 142.89 | 66.0 | 6.0 | |
| I-2 | 161.89 | 68.0 | 2.0 | Second |
| J-2 | 182.73 | 80.0 | 2.0 | Addition |
| K-2 | 191.34 | 90.0 | 2.0 | |
| | 199.64 | 100.0 | 2.0 | |

Crystal growth was carried out as follows. First addition was carried out while adjusting the temperature and the pAg of the composition in the reaction vessel to 75° C. and 8.8, respectively. Thereafter, the temperature of the composition in said reaction vessel was lowered to 60° C. over a period of 15 minutes, and Composition N-2 was added over a period of 4 minutes, and subsequently, 0.51 mole of Composition K-2 was added over a period of 15 minutes. Thereafter, a second addition was carried out. Said second addition was carried out adjusting the temperature, pAg and pH of the composition in said reaction vessel to 60° C., 9.8, and 5.8, respectively. If desired, Composition L-2 as well as Composition M-2 was added to control the pAg, as well as the pH.

Just prior to the first addition of Compositions I-2 J-2, and K-2, Composition I-3 described below was added, and immediately after the first addition, Composition J-3 also described below was added, whereby the resulting mixture underwent reduction sensitization.

| | |
|---|---|
| Composition I-3 | |
| Aqueous solution containing $1 \times 10^{-5}$ mole of thiourea dioxide per mole of silver halide | 100 ml |
| Composition J-3 | |
| Aqueous solution containing $2.5 \times 10^{-4}$ mole of sodium ethylthiosulfonate per mole of silver halide | 100 ml |

After the grain formation, Ultrafiltration A described below was carried out, and subsequently, the temperature was raised to 60° C. Thereafter, the pBr was adjusted to 1.7 by adding a 2 moles/liter aqueous potassium bromide solution, and further, Composition Q-1 described below, was added in an amount of 5.0 mole percent with respect to the total silver halide. Subsequently, the resulting mixture underwent ripening for 30 minutes, whereby Emulsion Em-11 was prepared.

(Ultrafiltration A)

The silver halide emulsion was subjected to repeated water addition and concentration while being circulated through an ultrafiltration module (Type ALP-1010 employing a polyacrylonitrile membrane having a differential molecular weight of 13,000, manufactured by Asahi Kasei Kogyo Co.), whereby finally, the pBr was adjusted to 3.0 at 40° C.

Composition Q-1

Fine grain emulsion comprised of 3.0 percent gelatin and fine silver bromide grains (having an average grain diameter of 0.05 pm)

Preparation Method: Added over a period of 10 minutes to 5,000 ml of a 6.0 percent gelatin solution containing 0.06 mole of potassium bromide were 2,000 ml of an aqueous solution containing 7.06 moles of silver nitrate and 2,000 ml of an aqueous solution containing 7.06 moles of potassium bromide at the same addition rate. The pH during the formation of fine particles was adjusted to 3.0 by adding nitric acid, while the temperature was maintained at 30° C. After completion of the addition, the pH was adjusted to 6 by adding an aqueous sodium carbonate solution, and subsequently, said Ultrafiltration A was carried out.

After the grain formation, the desalting treatment was carried out employing a method described in Japanese Patent Publication Open to Public Inspection No. 5-72658. Subsequently, dispersion was carried out by adding gelatin, whereby an emulsion at a pAg of 8.06 and a pH of 5.8 at 40° C. was prepared.

Silver halide grains in the resulting emulsion were observed employing an electron microscope. Then, it was found that said grains were comprised of hexagonal tabular monodispersed silver halide grains, having an average grain diameter of 1.30 $\mu$m, a grain size distribution of 17 percent, and an aspect ratio of 8.0. It was also found that said tabular silver halide grains possessed dislocation lines on the circumferential area.

After melting the resulting emulsion by heating, each of Sensitizing Dyes SI-1 and SI-2 was added in an amount of $5 \times 10^{-4}$ mole per mole of silver, and in addition, sodium thiosulfate pentahydrate, triphenylphosphine selenide, chloroauric acid, and potassium thiocyanate were added in an appropriate amount. Subsequently, ripening was carried out to obtain the desired sensitivity. At the completion of said ripening, Stabilizer ST-1 as well as Antifoggant AF-4 was added, and the resulting emulsion was cooled and solidified whereby Em-11 was prepared.

SI-1

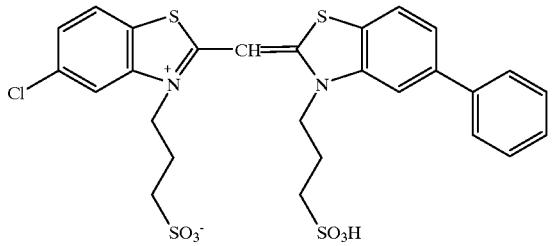

SI-2

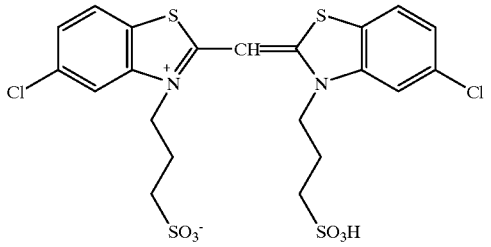

(Preparation of Light-Sensitive Color Material)

Sample 201 was prepared in the same manner as Sample 101, except that in Example 1, Iodobromide Emulsion f, SD-11, and SD-12 of the twelfth layer was replaced with Em-11.

Samples 202 through 252 were prepared in the same manner as Sample 201, except that compounds, described in Table 6, were added to the third layer, the fourth layer, the fifth layer the seventh layer, the eighth layer, the ninth layer, the eleventh layer, and the twelfth layer of said Sample 201 in an amount of $2.7\times10^{-5}$ mole per mole of silver.

Each sample was subjected to exposure and photographic processing in the same manner as Example 1. Subsequently, fog, sensitivity, and pressure resistance were evaluated. Incidentally, said sensitivity was obtained as follows. The inverse of the exposure amount, which resulted in the minimum density plus 0.3, was obtained for yellow density by sensitometry, and the resulting sensitivity was represented by a relative value (blue sensitivity) using the sensitivity of Sample 101 as 100. Said fog was represented by the value which was obtained by subtracting the density of each sample, which had been subjected to photographic processing without color development step, from the density of the same sample which had been subjected to the photographic processing.

TABLE 6

| Sample No. | Type of Added Compound | Blue Sensitivity | Fog | Pressure Fog | Remarks |
|---|---|---|---|---|---|
| 201 | — | 100 | 0.54 | 0.79 | Comp. |
| 202 | Comparative Compound 1 | 94 | 0.32 | 0.67 | Comp. |
| 203 | Comparative Compound 2 | 85 | 0.28 | 0.64 | Comp. |
| 204 | Comparative Compound 3 | 96 | 0.22 | 0.60 | Comp. |
| 206 | 2-1 | 101 | 0.13 | 0.52 | Inv. |
| 207 | 2-4 | 99 | 0.16 | 0.51 | Inv. |
| 208 | 2-21 | 99 | 0.21 | 0.52 | Inv. |
| 209 | 3-1 | 101 | 0.18 | 0.53 | Inv. |
| 210 | 3-2 | 102 | 0.16 | 0.51 | Inv. |
| 211 | 3-8 | 99 | 0.20 | 0.55 | Inv. |
| 212 | 4-1 | 100 | 0.19 | 0.54 | Inv. |
| 213 | 4-5 | 101 | 0.16 | 0.50 | Inv. |
| 214 | 5-1 | 102 | 0.14 | 0.49 | Inv. |
| 215 | 5-3 | 101 | 0.15 | 0.49 | Inv. |
| 216 | 6-2 | 100 | 0.12 | 0.46 | Inv. |
| 217 | 6-4 | 101 | 0.13 | 0.47 | Inv. |
| 218 | 6-11 | 102 | 0.11 | 0.44 | Inv. |
| 219 | 6-15 | 102 | 0.12 | 0.45 | Inv. |
| 220 | 7-1 | 103 | 0.10 | 0.43 | Inv. |
| 221 | 7-8 | 101 | 0.11 | 0.46 | Inv. |
| 222 | 8-5 | 99 | 0.13 | 0.45 | Inv. |
| 223 | 8-8 | 100 | 0.12 | 0.47 | Inv. |
| 224 | 9-1 | 101 | 0.12 | 0.46 | Inv. |
| 225 | 9-2 | 99 | 0.13 | 0.45 | Inv. |
| 226 | 9-14 | 100 | 0.10 | 0.47 | Inv. |
| 227 | 9-18 | 101 | 0.12 | 0.46 | Inv. |
| 228 | 9-21 | 99 | 0.13 | 0.44 | Inv. |
| 229 | 9-27 | 101 | 0.11 | 0.44 | Inv. |
| 230 | 10-3 | 102 | 0.10 | 0.43 | Inv. |
| 231 | 11-2 | 99 | 0.13 | 0.48 | Inv. |
| 232 | 11-3 | 100 | 0.14 | 0.46 | Inv. |
| 233 | 11-6 | 101 | 0.15 | 0.49 | Inv. |
| 234 | 11-12 | 99 | 0.14 | 0.48 | Inv. |
| 235 | 11-17 | 101 | 0.15 | 0.5 | Inv. |
| 236 | 12-1 | 102 | 0.11 | 0.46 | Inv. |
| 237 | 12-5 | 99 | 0.12 | 0.48 | Inv. |
| 238 | 12-8 | 100 | 0.12 | 0.47 | Inv. |
| 239 | 13-6 | 98 | 0.14 | 0.49 | Inv. |
| 240 | 13-9 | 99 | 0.13 | 0.5 | Inv. |
| 241 | 14-1 | 101 | 0.15 | 0.47 | Inv. |
| 242 | 14-2 | 101 | 0.13 | 0.46 | Inv. |
| 243 | 14-8 | 99 | 0.14 | 0.48 | Inv. |
| 244 | 14-15 | 99 | 0.14 | 0.49 | Inv. |
| 245 | 14-17 | 100 | 0.13 | 0.48 | Inv. |
| 246 | 14-23 | 100 | 0.13 | 0.49 | Inv. |
| 247 | 14-29 | 99 | 0.14 | 0.5 | Inv. |
| 248 | 15-1 | 100 | 0.1 | 0.43 | Inv. |
| 249 | 15-2 | 101 | 0.09 | 0.44 | Inv. |

TABLE 6-continued

| Sample No. | Type of Added Compound | Blue Sensitivity | Fog | Pressure Fog | Remarks |
|---|---|---|---|---|---|
| 250 | 15-7 | 100 | 0.09 | 0.42 | Inv. |
| 251 | 15-8 | 102 | 0.1 | 0.43 | Inv. |
| 252 | 15-11 | 100 | 0.08 | 0.42 | Inv. |

Inv.; Present Invention, Comp.; Comparative Example

As can clearly be seen from Table 6, samples, which were prepared by employing emulsions comprised of tabular grains, which had undergone reduction sensitization, while employing compounds represented by Formulas 1, 6 through 14, resulted in a decrease in the density of pressure fog noticed in bent samples, compared to comparative samples.

Regarding characteristics of sensitivity as well as fog, it was noted that samples employing compounds represented by Formulas 1, 6 through 14, exhibited excellent characteristics in which fog was decreased while a decrease in sensitivity was barely noticeable (on the other hand, samples employing the comparative compounds resulted in a decrease in sensitivity).

<Evaluation of Storage Stability>

Each of the samples prepared in Example 1 was subjected to accelerated aging by being set aside at 60° C. and 80 percent relative humidity for 7 days. Thereafter, the resulting sample was subjected to wedge exposure in the same manner as Example 1 and subsequently subjected to photographic processing. The fog and sensitivity variation of each of the resulting samples were determined. Table 7 shows the results. Said fog was represented by a value which was obtained by subtracting the density of each sample which had been subjected to photographic processing, without the color development step, from the density of the same sample which had been subjected to the photographic processing. Said sensitivity was obtained as the inverse of the exposure amount, which resulted in the minimum density plus 0.3, and expressed by the relative value when the sensitivity of Sample 101 prior to said accelerated aging was 100.

TABLE 7

| Sample No. | Type of Added Compound | Blue Sensitivity after Accelerated aging test | Fog after Accelerated aging test |
|---|---|---|---|
| 101 | — | 82 | 0.48 |
| 116 | 6-2 | 96 | 0.04 |
| 119 | 6-15 | 96 | 0.07 |
| 127 | 9-18 | 94 | 0.02 |
| 130 | 10-3 | 95 | 0.06 |
| 132 | 11-3 | 92 | 0.11 |
| 135 | 11-17 | 93 | 0.12 |

Each of the samples prepared in Example 2 was subjected to accelerated aging in the same manner by being set aside at 60° C. and 80 percent relative humidity for 7 days. Thereafter, the resulting sample was subjected to wedge exposure in the same manner as Example 1 and subsequently subjected to photographic processing. The fog and sensitivity variation of each of the resulting samples were determined. Table 8 shows the results. Said fog was represented by a value which was obtained by subtracting the density of each sample which had been subjected to photographic processing, without the color development step, from the density of the same sample which had been subjected to the photographic processing. Said sensitivity was obtained as the inverse of the exposure amount, which resulted in the minimum density plus 0.3, and expressed by the relative value when the sensitivity of Sample 201 prior to said accelerated aging was 100.

TABLE 8

| Sample No. | Type of Added Compound | Blue Sensitivity after Accelerated aging test | Fog after Accelerated aging test |
|---|---|---|---|
| 201 | — | 80 | 0.69 |
| 216 | 6-2 | 95 | 0.17 |
| 219 | 6-15 | 93 | 0.18 |
| 227 | 9-18 | 93 | 0.17 |
| 230 | 10-3 | 94 | 0.14 |
| 232 | 11-3 | 92 | 0.20 |
| 235 | 11-17 | 92 | 0.21 |

What is claimed is:

1. A silver halide color photographic light-sensitive material comprising a support having thereon a light-sensitive silver halide emulsion layer comprising a DIR coupler and a compound selected from the group of compounds represented by Formula 6 to Formula 14, Formula 6

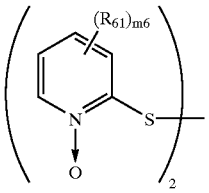

Formula 7

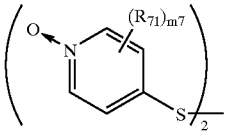

Formula 8

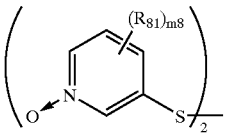

Formula 9

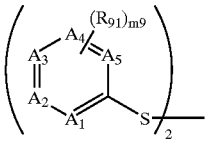

Formula 10

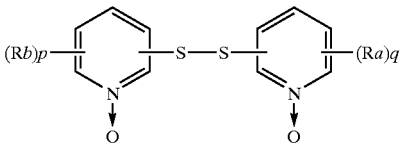

Formula 11

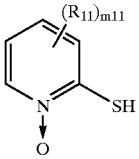

-continued

Formula 12

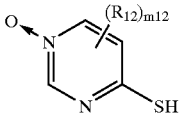

Formula 13

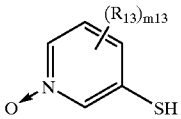

Formula 14

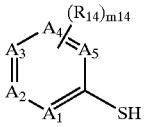

wherein $R_{61}$, $R_{71}$, $R_{81}$, and $R_{91}$ each represent a substituent; $m_6$ represents an integer of 1 to 4; $m_7$ and $m_8$ represent an integer of 0 to 4; $m_9$ represents an integer of 0 to 3; when $m_6$, $m_7$, $m_8$ and $m_9$ are 2 or more, $R_{61}$, $R_{71}$, $R_{81}$, and $R_{91}$ may be a different substituent and may bond to each other to form a condensation ring; $A_1$, $A_2$, $A_3$, $A_4$, and $A_5$ each represent =N—, =CH—, $=CR_{92}$—, or =N(→O)—, and at least two of $A_1$, $A_2$, $A_3$, $A_4$, and $A_5$ represent =N— or =N(→O)—, and at least one represents =N(→O)—; and $R_{92}$ represents a substituent; Ra and Rb each represent an electron attractive group and may be the same or different, and p and q each represent an integer of 1 to 4; $R_{11}$, $R_{12}$, $R_{13}$, and $R_{14}$ each represent a substituent; $m_{11}$ represents an integer of 1 to 4; $m_{12}$ and $m_{13}$ each represent an integer of 0 to 4; $m_{14}$ represents an integer of 0 to 3.

2. The photographic material of claim 1, wherein the emulsion is subjected to reduction sensitization.

3. The photographic material of claim 1, wherein the compound is selected from the group of compounds represented by Formula 6 to Formula 10.

4. The photographic material of claim 1, wherein the compound is selected from the group of compounds represented by Formula 11 to Formula 14.

5. The photographic material of claim 3, wherein each $R_{61}$, $R_{71}$, $R^{81}$, and $R_{91}$ in Formula 6 to Formula 9 represents a group which promotes adsorption onto silver halide grains.

6. The photographic material of claim 1, wherein the compound is contained in an amount of $1\times10^{-7}$ to $1\times10^{-1}$ mole per mole of Ag.

7. The photographic material of claim 3, wherein the compound is represented by Formula 10.

8. The photographic material of claim 3, wherein the compound is represented by Formula 6.

9. The photographic material of claim 3, wherein the compound is represented by Formula 7.

10. The photographic material of claim 3, wherein the compound is represented by Formula 8.

11. The photographic material of claim 3, wherein the compound is represented by Formula 9.

12. The photographic material of claim 3, wherein the emulsion contains a tabular silver halide grain.

* * * * *